US006157359A

United States Patent [19]

Shimakura et al.

[11] Patent Number: 6,157,359

[45] **Date of Patent: *Dec. 5, 2000**

[54] DISPLAY CONTROL APPARATUS

[75] Inventors: Masami Shimakura, Tokyo; Toshiyuki Nobutani; Junichi Tanahashi, both of Yokohama; Kenichiro Ono, Kawasaki; Hajime Morimoto, Tokyo; Tatsuya Sakashita, Yokohama; Eiichi Matsuzaki, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/615,787

[22] Filed: Mar. 14, 1996

Related U.S. Application Data

[63] Continuation of application No. 08/114,308, Sep. 2, 1993, abandoned.

[30] Foreign Application Priority Data

Sep. 4, 1992 [JP] Japan ..... 4-237445
Sep. 4, 1992 [JP] Japan ..... 4-237477
Sep. 4, 1992 [JP] Japan ..... 4-237478

[51] Int. Cl.[7] ..... G09G 3/36

[52] U.S. Cl. ..... 345/98; 345/87; 345/97

[58] Field of Search ..... 345/97, 98, 99, 345/101, 87, 94, 90, 507, 103; 348/790, 792, 793

[56] References Cited

U.S. PATENT DOCUMENTS 4,693,563 9/1987 Harada et al. ..... 345/97
4,964,699 10/1990 Inoue ..... 350/332
5,091,723 2/1992 Kanno et al. ..... 345/97
5,321,418 6/1994 Leroux ..... 345/89

FOREIGN PATENT DOCUMENTS 0289144 11/1988 European Pat. Off. .
0361471 4/1990 European Pat. Off. .
0368117 5/1990 European Pat. Off. .
0478382 4/1992 European Pat. Off. .

OTHER PUBLICATIONS

*Old Thinking, New Methods and Television*, Wireless World, Jan. 1969 issue.

*Primary Examiner*—Dennis-Doon Chow
*Attorney, Agent, or Firm*—Fitzpatrick, Cella, Harper & Scinto

[57] ABSTRACT

A display control apparatus for a display device capable of performing updating of a display state for a display element subjected to a change in display includes a display data memory for storing display data, a display controller capable of sequentially reading out the display data stored in the memory and transferring the readout display data to the display device at a predetermined period and capable of performing a partial rewrite operation of the display data stored in the memory, and a rewrite detector for detecting an address for accessing the display data memory to cause the display controller to perform the partial rewrite operation. In addition, a transfer permitting unit reads the address detected by the rewrite detector and permits transfer of only the display data of the read address to the display controller.

15 Claims, 36 Drawing Sheets

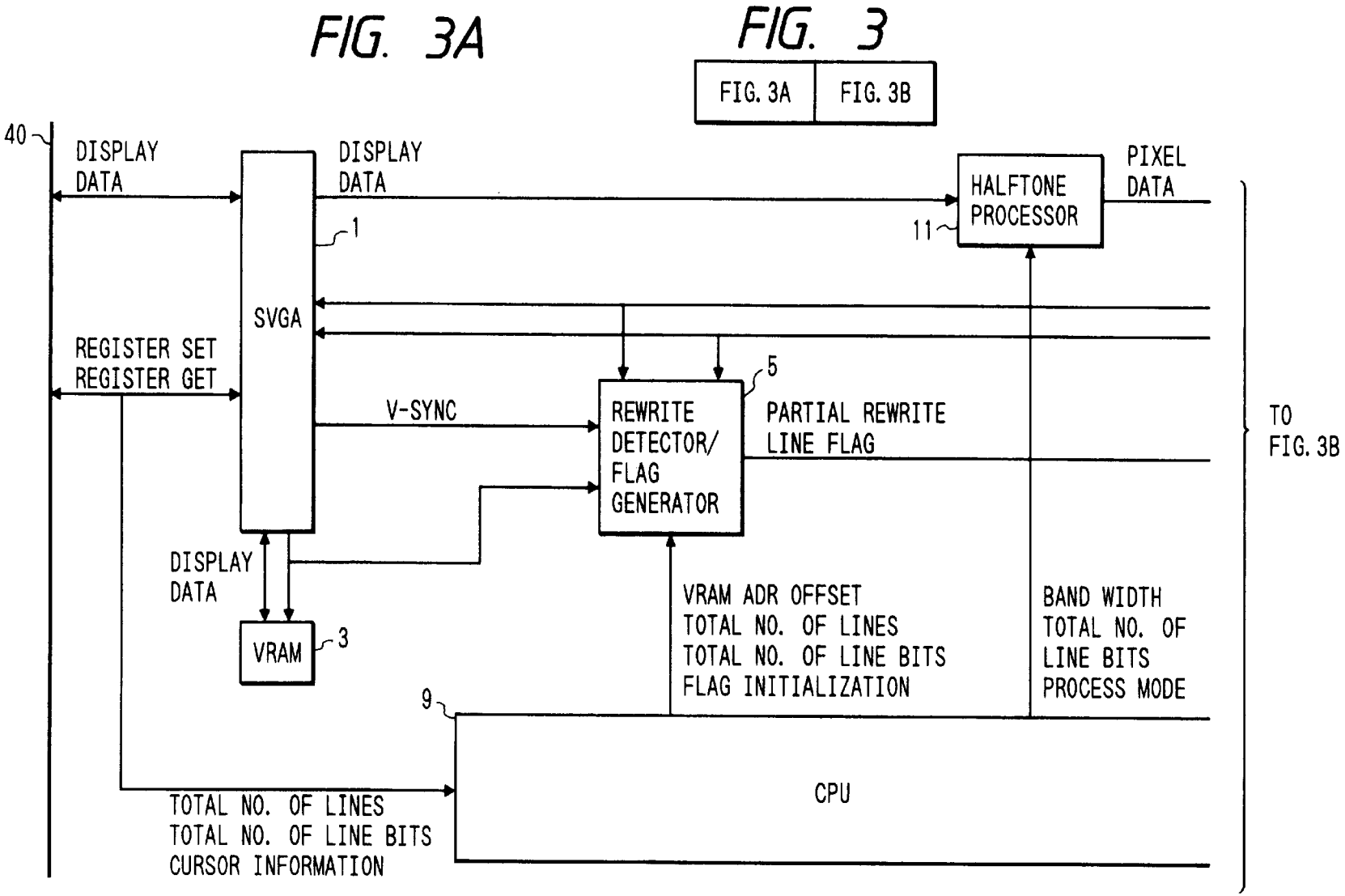
FIG. 3
FIG. 3A
FIG. 3B
FIG. 3A
TO FIG. 3B
PIXEL DATA
HALFTONE PROCESSOR
11
BAND WIDTH
TOTAL NO. OF LINE BITS
PROCESS MODE
PARTIAL REWRITE LINE FLAG
5
REWRITE DETECTOR/ FLAG GENERATOR
VRAM ADR OFFSET
TOTAL NO. OF LINES
TOTAL NO. OF LINE BITS
FLAG INITIALIZATION
CPU
9
DISPLAY DATA
1
SVGA
V-SYNC
3
VRAM
DISPLAY DATA
TOTAL NO. OF LINES
TOTAL NO. OF LINE BITS
CURSOR INFORMATION
DISPLAY DATA
REGISTER SET
REGISTER GET
40

TO FIG. 12B
PIXEL DATA
HALFTONE PROCESSOR
11
BAND WIDTH
TOTAL NO. OF LINE BITS
PROCESS MODE
PARTIAL REWRITE LINE FLAG
5A
FLAG GENERATOR
TOTAL NO. OF LINES
FLAG INITIALIZATION
CPU
9
DISPLAY DATA
1A
SVGA
REWRITE LINE ADDRESS
V-SYNC
3
VRAM
DISPLAY DATA
REGISTER SET
REGISTER GET
TOTAL NO. OF LINES
TOTAL NO. OF LINE BITS
CURSOR INFORMATION
DISPLAY DATA
40

TO FIG. 15B
PIXEL DATA
HALFTONE PROCESSOR
11
BAND WIDTH
TOTAL NO. OF LINE BITS
PROCESS MODE
FLAG INITIALIZATION
CPU
PARTIAL REWRITE LINE FLAG
9
DISPLAY DATA
1B
SVGA
3
VRAM
DISPLAY DATA
REGISTER SET
REGISTER GET
TOTAL NO. OF LINES
TOTAL NO. OF LINE BITS
CURSOR INFORMATION
DISPLAY DATA
40

TO FIG. 23B
PIXEL DATA
HALFTONE PROCESSOR
11
BAND WIDTH
TOTAL NO. OF LINE BITS
PROCESS MODE
FLAG INITIALIZATION
CPU
9A
REFRESH MODE TABLE
PARTIAL REWRITE LINE FLAG
9
DISPLAY DATA
1
SVGA
3
VRAM
DISPLAY DATA
TOTAL NO. OF LINES
TOTAL NO. OF LINE BITS
CURSOR INFORMATION
DISPLAY DATA
REGISTER SET
REGISTER GET
40

FIG. 25

| TEMPERATURE | | TRIMMER | | INTERLACE VALUE | PARTIAL REWRITE:REFRESH |
|---|---|---|---|---|---|
| 0 | 0 | 0 | 0 | 4 | 100 : 200 |
| | | 0 | 1 | 4 | 50 : 150 |
| | | 1 | 0 | 3 | 100 : 200 |
| | | 1 | 1 | 3 | 50 : 150 |
| 0 | 1 | 0 | 0 | 3 | 100 : 200 |
| | | 0 | 1 | 3 | 50 : 150 |
| | | 1 | 0 | 2 | 100 : 200 |
| | | 1 | 1 | 2 | 50 : 150 |
| 1 | 0 | 0 | 0 | 2 | 90 : 210 |
| | | 0 | 1 | 2 | 70 : 230 |
| | | 1 | 0 | 2 | 50 : 250 |
| | | 1 | 1 | 2 | 30 : 270 |
| 1 | 1 | 0 | 0 | 1 | 30 : 270 |
| | | 0 | 1 | 1 | 20 : 280 |
| | | 1 | 0 | 1 | 10 : 290 |
| | | 1 | 1 | 1 | 0 : 300 |

FIG. 28

| DECODER OUTPUT \ INTER-LACE | 0 | 1 | 2 | 3 | 4 | ----- N |
|---|---|---|---|---|---|---|
| 0 | 1 | 1 | 1 | 1 | 1 | 1 |
| 1 | 0 | 1 | 1 | 1 | 1 | 1 |
| 2 | 0 | 0 | 1 | 1 | 1 | 1 |
| 3 | 0 | 0 | 0 | 1 | 1 | 1 |
| 4 | 0 | 0 | 0 | 0 | 1 | 1 |
| ⋮ | ⋮ | ⋮ | ⋮ | ⋮ | ⋮ | ⋮ |
| N | 0 | 0 | 0 | 0 | 0 | 1 |

DISPLAY CONTROL APPARATUS

This application is a continuation of application Ser. No. 08/114,308, filed Sep. 2, 1993, now abandoned.

BACKGROUND OF THE INVENTION

1. Field of the Invention

The present invention relates to a display control apparatus and, more particularly, to a display control apparatus for a display device having a display element which uses, e.g., a ferroelectric liquid crystal as an operating medium for updating a display state and can hold an updated display state upon application or the like of an electric field.

2. Related Background Art

A display device is used as an information display means for achieving a visual information representing function in an information processing system or the like. A CRT display device (to be referred to as a CRT hereinafter) is generally used as such a display device.

Various information processing systems such as so-called personal computers are available in accordance with hardware, software, and signal transmission schemes. In this case, CRT display control apparatuses (CRTC) unique to various systems are used. Such CRTCs are exemplified by a VGA81 (available from IBM) as a VGA (Video Graphics Array) dedicated for an information processing system PC-AT (available from IBM) and an 86C911 (available from S3) as an SVGA (Super VGA) obtained such that an accelerator function for displaying predetermined images such as a circle and a rectangle is added to the VGA.

FIG. 1 is a block diagram showing an SVGA arrangement used in a CRTC.

When the host CPU of an information processing system partially rewrites a display memory window area in a host memory space, the rewritten display data is transferred to a VRAM 3 through a system bus 40 and a SVGA 1. The SVGA 1 generates a VRAM address on the basis of the address of the display memory window area and rewrites the display data in the VRAM 3 which is located at this VRAM address.

Meanwhile, the SVGA 1 accesses the VRAM 3 at the same period as the scan period of the CRT and sequentially reads out display data developed in the VRAM 3. The readout data are transferred to a RAMDAC 2. The RAMDAC 2 sequentially converts the input display data into R, G, and B analog signals and transfers the converted analog signals to a CRT 4. The SVGA used as the CRT display control apparatus functions to unconditionally transfer the display data at a predetermined period to the CRT.

In the above CRT display control, since the VRAM 3 comprises a dual port RAM, the VRAM 3 can independently perform an operation of writing display data in the VRAM to update the display information and an operation of reading out the display data from the VRAM. For this reason, the host CPU need not consider display timings and the like at all. Desired display data can be advantageously written at an arbitrary timing.

A CRT requires particularly a length in the direction of thickness of the display screen and has a large volume. It is difficult to obtain a compact CRT as a display device as a whole. This limits the degree of freedom of an information processing system using a CRT as a display. That is, the degrees of freedom in installation locations and portability are decreased.

A liquid crystal display (to be referred to as an LCD hereinafter) can be used as a display device which can compensate for the above drawbacks. More specifically, an LCD can achieve compactness (particularly, a low-profile configuration) of the display device as a whole. Of such LCDs, a display using a liquid crystal cell containing a ferroelectric liquid crystal (to be referred to as an FLC) is available. This display will be referred to as an FLCD hereinafter. One of the characteristic features of the FLCD lies in that the display state of the liquid crystal cell is preserved upon application of an electric field. That is, its liquid crystal cell is sufficiently thin, the elongated FLC molecules in the cell are aligned in the first or second stable state in accordance with an electric field application direction, and the aligned state of the molecules is maintained after the electric field is withdrawn. The FLCD has a memory function due to the above bistable operations of the FLC molecules. The details of the FLC and FLCD are described in U.S. Pat. No. 4,964,699.

Although the FLCD has the above memory function, it has a low FLC display updating speed. The FLCD cannot follow up with changes in display information which must be instantaneously updated. Such operations are exemplified by cursor movement, a character input, and scrolling.

In FLCDs having the above characteristics, various display drive modes which have originated from these characteristics or compensate for these characteristics are available. More specifically, in refresh driving for sequentially and continuously driving scan lines on the display screen as in a CRT and any other liquid crystal display, a relatively large time margin is available in its drive period. In addition to this refresh driving, partial rewrite driving for updating the display state of a part (line) subjected to a change on the display screen and interlace driving for interlacing and driving scan lines on the display screen are also proposed. The display information change speed can be increased by the partial rewrite driving or the interlace driving.

If display control of the FLCD having the above advantages can be performed using an existing CRT display controller, an information processing system using an FLCD as a display device can be arranged at a relatively low cost.

SUMMARY OF THE INVENTION

It is an object of the present invention to provide a display control apparatus capable of properly controlling FLCD display by utilizing a CRT display controller.

In particular, it is another object of the present invention to provide a display control apparatus capable of properly performing a partial rewrite operation unique to the FLCD.

In order to achieve the above object according to an aspect of the present invention, there is provided a display control apparatus for a display device capable of performing updating of a display state for only a display element subjected to a change in display, comprising display data memory means for storing display data, a display controller capable of sequentially reading out the display data stored in the memory means and transferring the readout display data to the display device at a predetermined period and capable of performing a partial rewrite operation of the display data stored in the memory means, rewrite detecting means for detecting an address for accessing the display data memory means to cause the display controller to perform the partial rewrite operation, and transfer permitting means for reading the address detected by the rewrite detecting means and permitting transfer of only the display data of the read address to the display controller.

With the above arrangement, when the display controller rewrites the display data, the address of this display data is detected, and only the display data at the detected address is read by the display controller. The readout data is transferred to the display device.

In order to achieve the above object according to another aspect of the present invention, there is provided a display control apparatus for a display device capable of performing updating of a display state for a display element subjected to a change in display, comprising display data memory means for storing display data, a display controller capable of sequentially reading out the display data stored in the memory means and transferring the readout display data to the display device at a predetermined period and capable of performing a partial rewrite operation of the display data stored in the memory means, rewrite detecting means for detecting an address for accessing the display data memory means to cause the display controller to perform the partial rewrite operation, specific pattern rewrite detecting means for detecting an address of the display data subjected to a rewrite operation of the specific pattern in the display data memory means, and transfer permitting means for reading the address detected by the rewrite detecting means and permitting transfer of only the read address and the display data of the read address to the display controller, the transfer permitting means transferring the read address in units of blocks.

With the above arrangement, when the display controller is allowed to read and transfer the display data, the addresses of the plurality of display data can be transmitted in units of blocks.

In order to achieve the above object according to still another aspect of the present invention, there is provided a display control apparatus for a display device capable of performing updating of a display state for a display element subjected to a change in display, comprising display data memory means for storing display data, a display controller capable of sequentially reading out the display data stored in the memory means and transferring the readout display data to the display device at a predetermined period and capable of performing a partial rewrite operation of the display data stored in the memory means, the display controller having an interlace address generator for generating an address corresponding to a set interlace value, and line address generating means for transferring the address generated by the interlace address generator to the display controller and transferring display data of the transfer address to the display device.

With the above arrangement, the address corresponding to the set interlace value is generated by the interlace address generator arranged in the display controller, and interlace display based on the display data at this address is performed.

BRIEF DESCRIPTION OF THE DRAWINGS

FIG. 25 is a view illustrating a refresh mode table shown in FIG. 23;

FIG. 28 is a view for explaining a decoding relationship of a decoder shown in FIG. 27;

DETAILED DESCRIPTION OF THE PREFERRED EMBODIMENTS

Preferred embodiments of the present invention will be described in detail with reference to the accompanying drawings.

Figure 1:
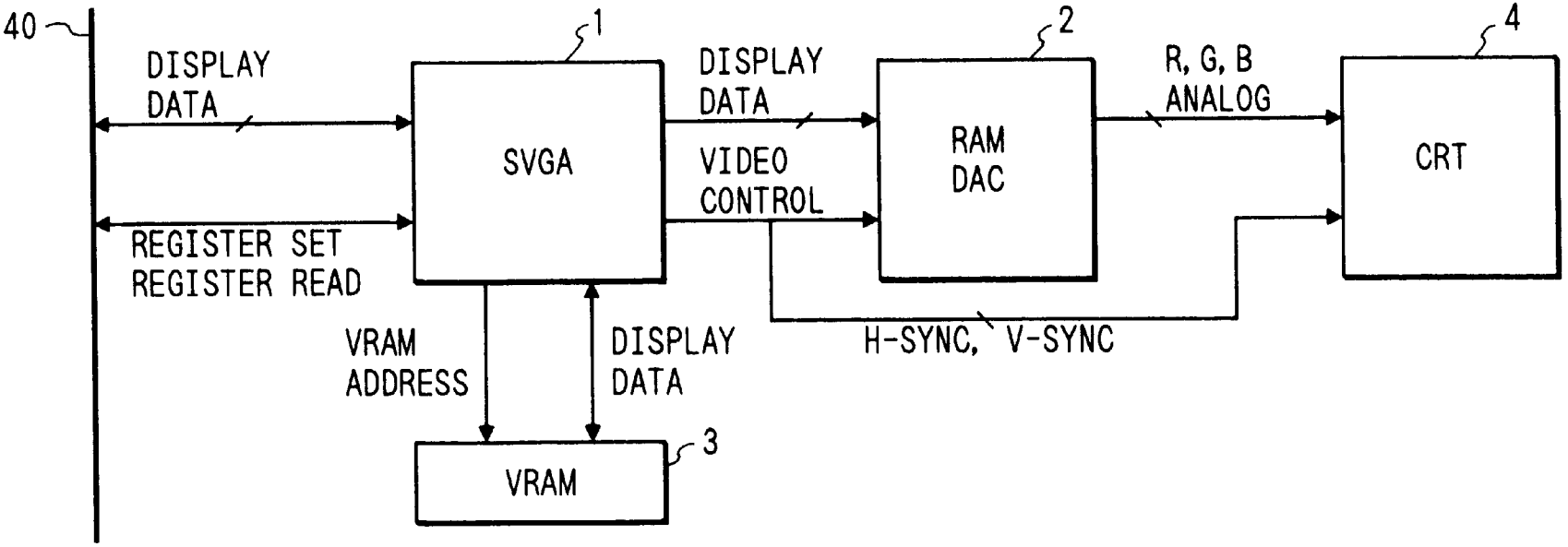
FIG. 1 PRIOR ART
FIG. 1 is a block diagram showing a conventional display control apparatus.
Figure 2:
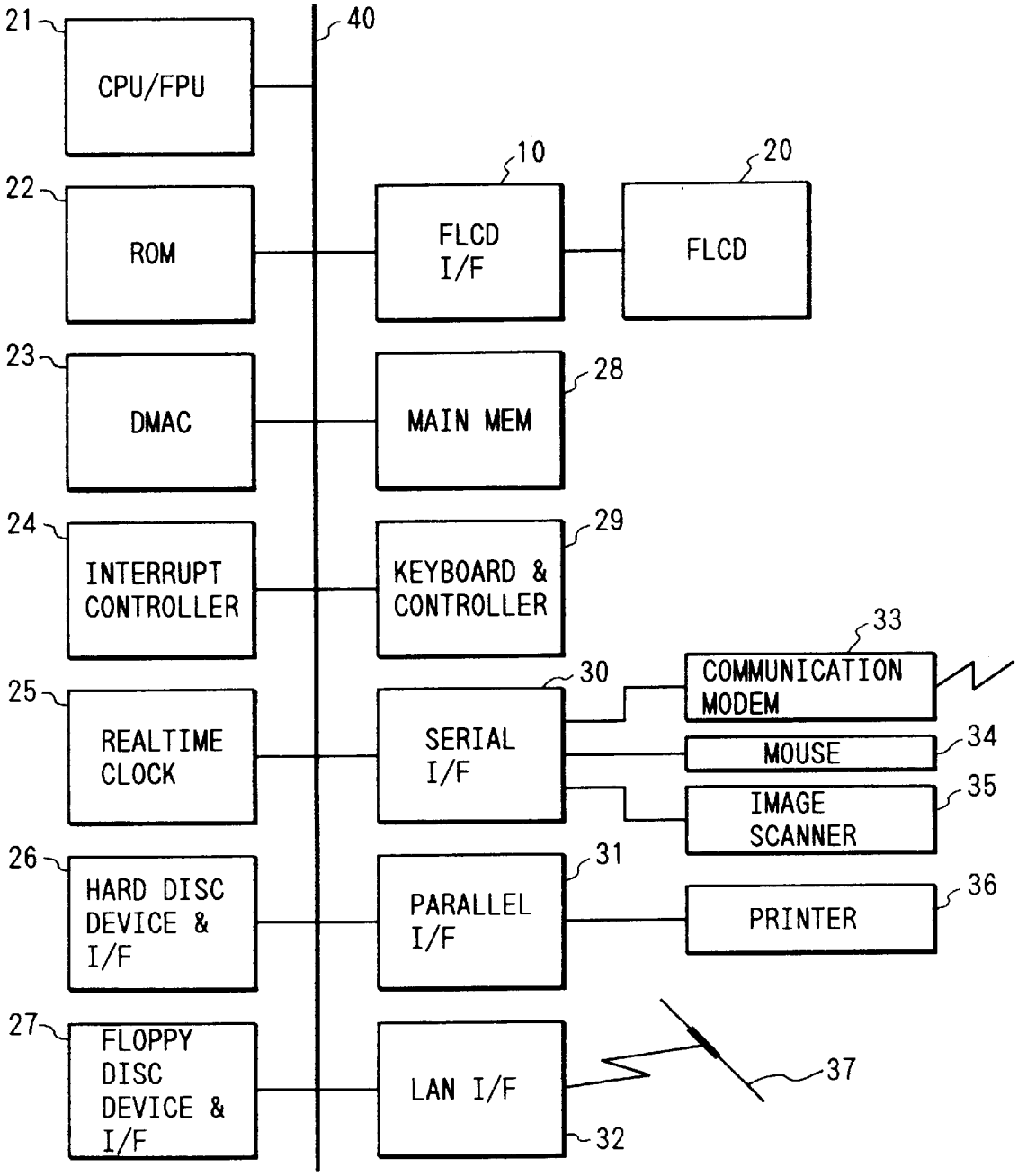
FIG. 2 is a block diagram showing an information processing system according to the first embodiment of the present invention.

FIG. 2 is a block diagram of an information processing system in which an FLC display device having a display control apparatus according to an embodiment of the present invention is used as a display device for displaying various characters and image information.

Referring to FIG. 2, the information processing system includes a CPU 21, a ROM 22, a main memory 28, a DMA controller (Direct Memory Access Controller; to be referred to as a DMAC hereinafter) 23, a LAN (Local Area Network) interface 32, a hard disk device & I/F 26, a LAN 37, a floppy disk device & I/F 27, a printer 36, a parallel I/F 31, a keyboard & controller 29, a communication modem 33, a mouse 34, an image scanner 35, a serial I/F 30, an interrupt controller 24, a real time clock 25, an FLC display device (to be also referred to an FLCD hereinafter) 20, an FLCD interface 10, and a system bus 40. The CPU 21 controls the overall information processing system. The ROM 22 stores programs executed by the CPU 21. The main memory 28 is used as a work area or the like in execution of programs. The DMAC 23 transfers data between the main memory 28 and the respective components constituting this system without control of the CPU 21. The LAN I/F 32 serves as an interface between the LAN 37 such as Ethernet (available from XEROX) and this system. The printer 36 can be constituted by an ink-jet or laser beam printer capable of performing recording at a relatively high resolution. The parallel I/F 31 connects signals between the printer and this system. The keyboard & controller 29 inputs information such as character information (e.g., various characters) and control information. The communication modem 33 performs signal modulation between the communication line and this system. The mouse 34 serves as a pointing device. The image scanner 35 reads an image or the like. The communication modem 33, the mouse 34, and the image scanner 35 exchange signals with this system through the serial I/F 30. The interrupt controller 24 controls an interrupt operation in execution of a program. The real time clock 25 controls a timepiece function in this system. The display operation of the FLCD 20 is controlled by the FLCD interface 10 serving as the display control apparatus of this embodiment. The FLCD 20 has a display screen using the ferroelectric liquid crystal as a display operating medium. A display memory window area which can be accessed by the CPU 21 is also developed in the FLCD I/F 10. The system bus 40 comprises a data bus, a control bus, and an address bus to connect signals between the respective components.

In the information processing system in which the above components are connected, a user generally performs operations in correspondence with various kinds of information displayed on the display screen of the FLCD 20. More specifically, character information and image information which are supplied from an external device connected to the LAN 37, the hard disk device & I/F 26, the floppy disk device & I/F 27, the scanner 35, the keyboard & controller 29, and the mouse 34, and operation information stored in the main memory 28 upon operations of the user for the system are displayed on the display screen of the FLCD 20. The user performs information editing and operations for instructing the system while observing the display contents on the FLCD 20. The above components constitute a display information supply means for the FLCD 20.

First Embodiment

Figure 3B:
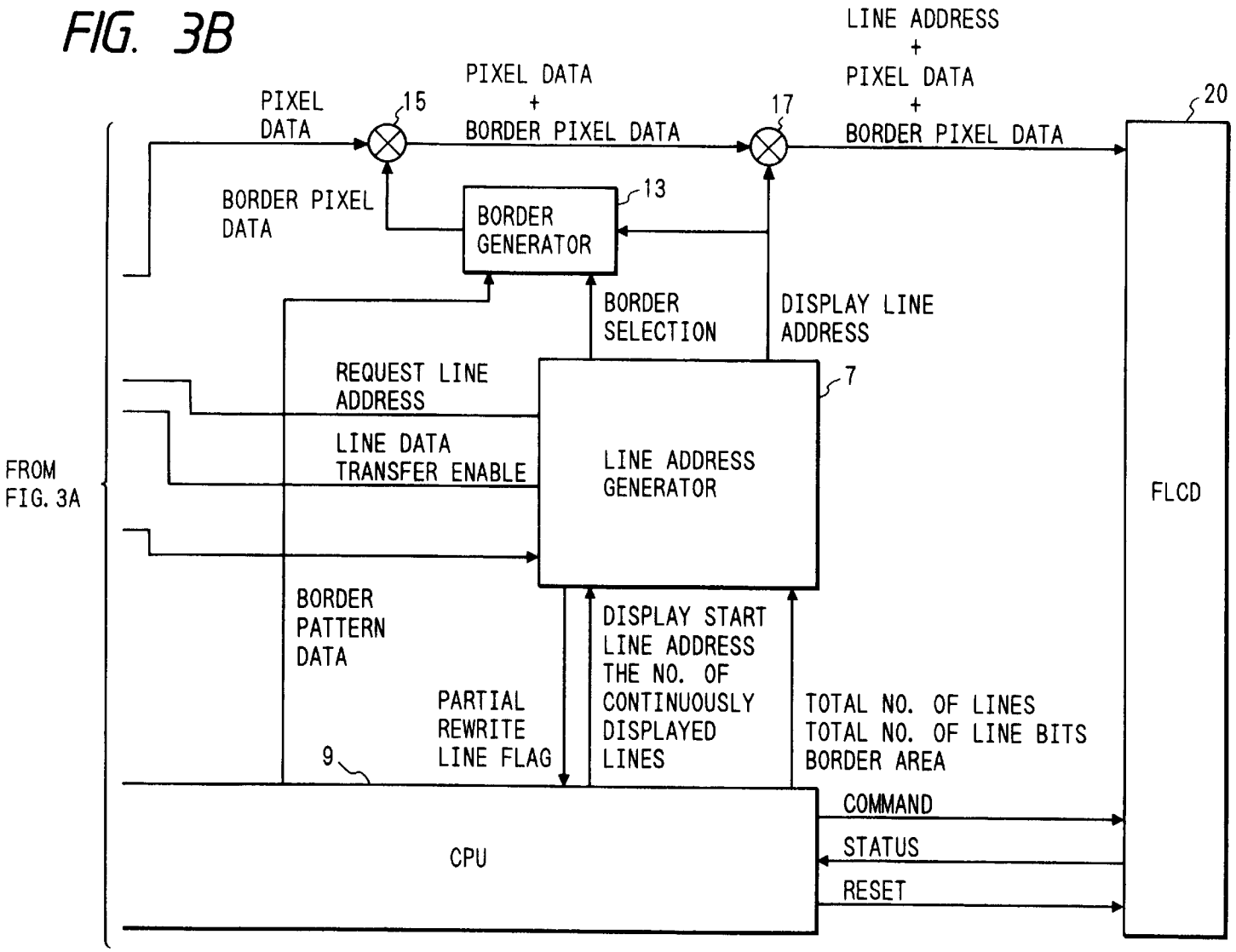
FIG. 3 is comprised of FIGS. 3A and 3B illustrating block diagrams showing a display control apparatus according to the first embodiment of the present invention.

FIGS. 3A and 3B are block diagrams showing the detailed arrangement of the FLCD I/F 10 according to the first embodiment of the present invention.

Referring to FIGS. 3A and 3B, an SVGA 1 using the exiting SVGA serving as a CRT display controller is used in the FLCD I/F 10, i.e., the display control apparatus. The arrangement of the SVGA 1 will be described with reference to FIG. 4.

Figure 4:
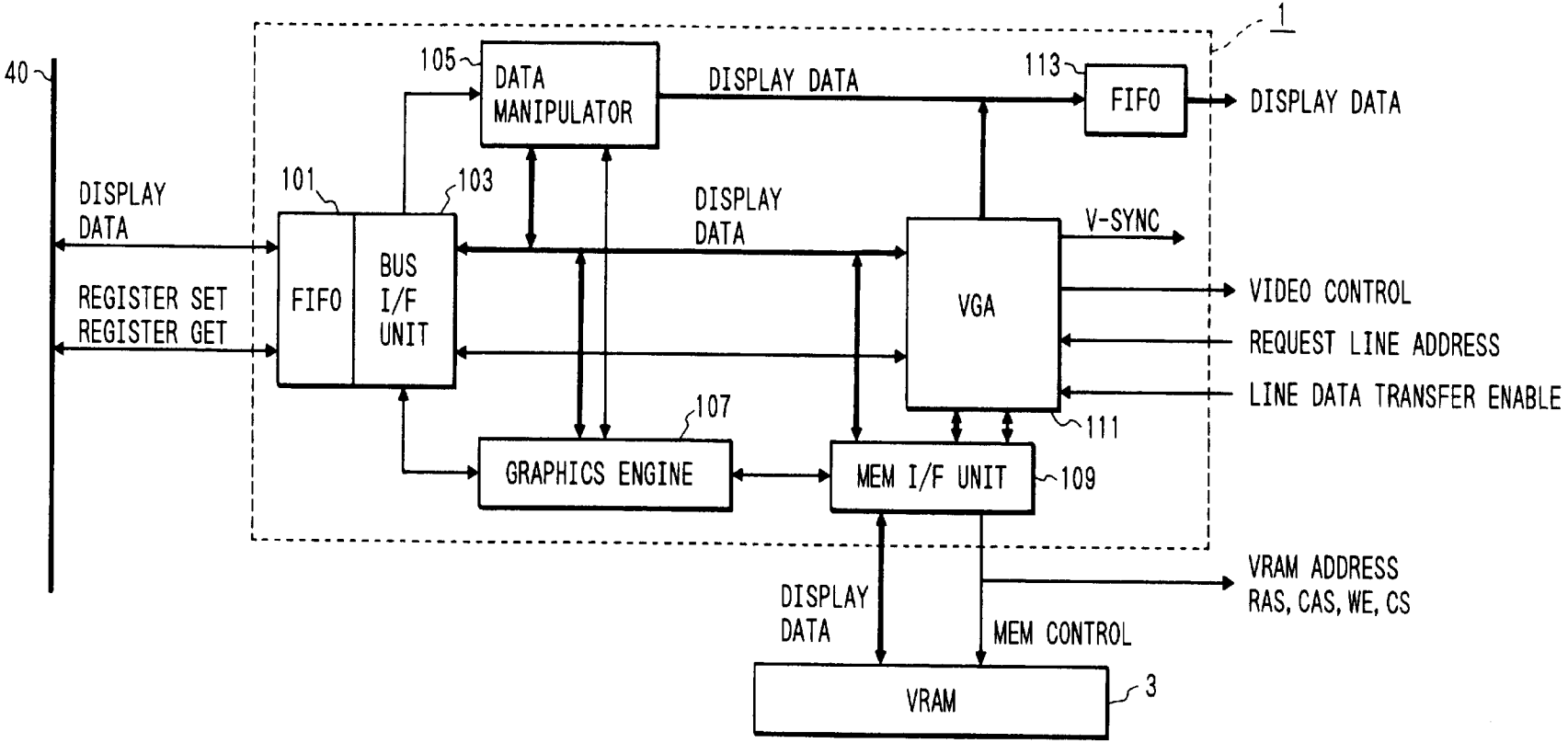
FIG. 4 is a block diagram showing the detailed arrangement of an SVGA shown in FIG. 3A and FIG. 3B.

Referring to FIG. 4, rewrite display data accessed by the host CPU 21 (FIG. 2) to perform a rewrite operation in the display memory window area of the FLCD I/F 10 (FIG. 2) is transferred through the system bus 40 and temporarily stored in a FIFO 101. Bank address data for mapping the display memory window area on an arbitrary area of a VRAM 3 is also transferred through the system bus 40. Display data has a form of 24 bits for expressing 256 gradation levels for each of the R, G, and B components. Control information such as a command and the bank address data from the CPU 21 is transferred in the form of register set data. Register set data for allowing the CPU 21 to detect the state on the SVGA side is transferred to the CPU 21. The register set data and the display data which are stored in the FIFO 101 are sequentially input, so that the registers in a bus I/F unit 103 and a VGA 111 are set in accordance with the output data. The VGA can know a bank address, its display data, and a control command in accordance with the set states of these registers.

The VGA 111 generates a VRAM address for the VRAM 3 on the basis of the address of the display memory window area and the bank address. At the same time, the VGA 111 transfers strobe signals RAS and CAS, a chip select signal CS, and a write enable signal WE, all of which serve as memory control signals, to the VRAM 3 through a memory I/F unit 109, thereby writing the display data at the VRAM address. At this time, the display data to be rewritten is transferred to the VRAM 3 through the memory I/F unit 109.

On the other hand, in response to a line data transfer enable signal transferred from a line address generator 7 (FIGS. 3A and 3B), the VGA 111 reads out the display data from the VRAM 3 which is specified by a request line address transferred from the line address generator 7. The VGA 111 then stores the readout data in a FIFO 113. The display data is sent from the FIFO 113 to the FLCD side in the display data storage order.

The SVGA 1 comprises a data manipulator 105 and a graphics engine 107, both of which provide the accelerator function as previously described, in addition to the cursor display circuit. For example, when the CPU 21 sets data associated with a circle, its center, and its radius in the registers of the bus I/F unit 103 to instruct drawing of the circle, the graphics engine 107 generates circle display data, and the data manipulator 105 writes the resultant data in the VRAM 3.

The SVGA 1 described with reference to FIG. 4 can be obtained by slightly modifying the VGA portion of the existing CRT SVGA.

Referring back to FIGS. 3A and 3B, a rewrite detector/flag generator 5 monitors a VRAM address generated by the SVGA 1 and fetches a VRAM address upon rewriting (writing) of the display data of the VRAM 3, i.e., a VRAM address obtained when the write enable signal and the chip select signal CS go to level "1". The rewrite detector/flag generator 5 calculates a line address on the basis of this VRAM address and data (i.e., a VRAM address offset, the total number of lines, and the total number of line bits) obtained from a CPU 9. The concept of this computation is shown in FIG. 5.

Figure 5:
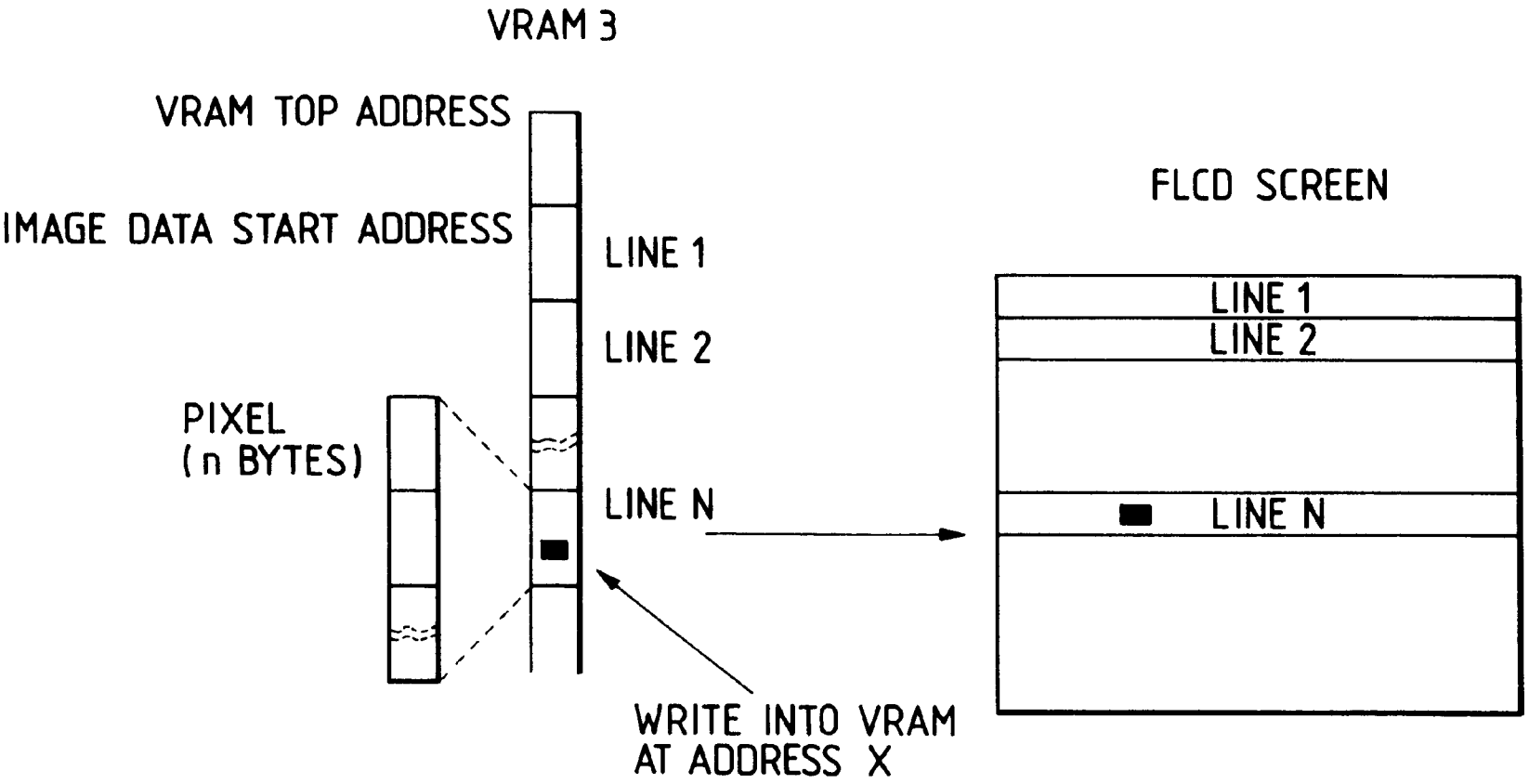
FIG. 5 is a view for explaining conversion from a VRAM address into a line address according to the first embodiment of the present invention.

As shown in FIG. 5, a pixel represented by an address X in the VRAM 3 corresponds to a line N on the FLCD screen. One line comprises a plurality of pixels, and each pixel is constituted by a plurality (n) of bytes. At this time, the line address (line number N) is computed as follows.

$$\text{Line No. } N = \frac{(VRAM\ Adress\ X) - (\text{Image Data Start Address})}{(\text{Number of Pixels per Line}) \times (\text{Number of Bytes per Pixel})} + 1$$

The rewrite detector/flag circuit 5 sets its internal partial rewrite line flag register in accordance with the computed line address. This state is shown in FIG. 6.

Figure 6:
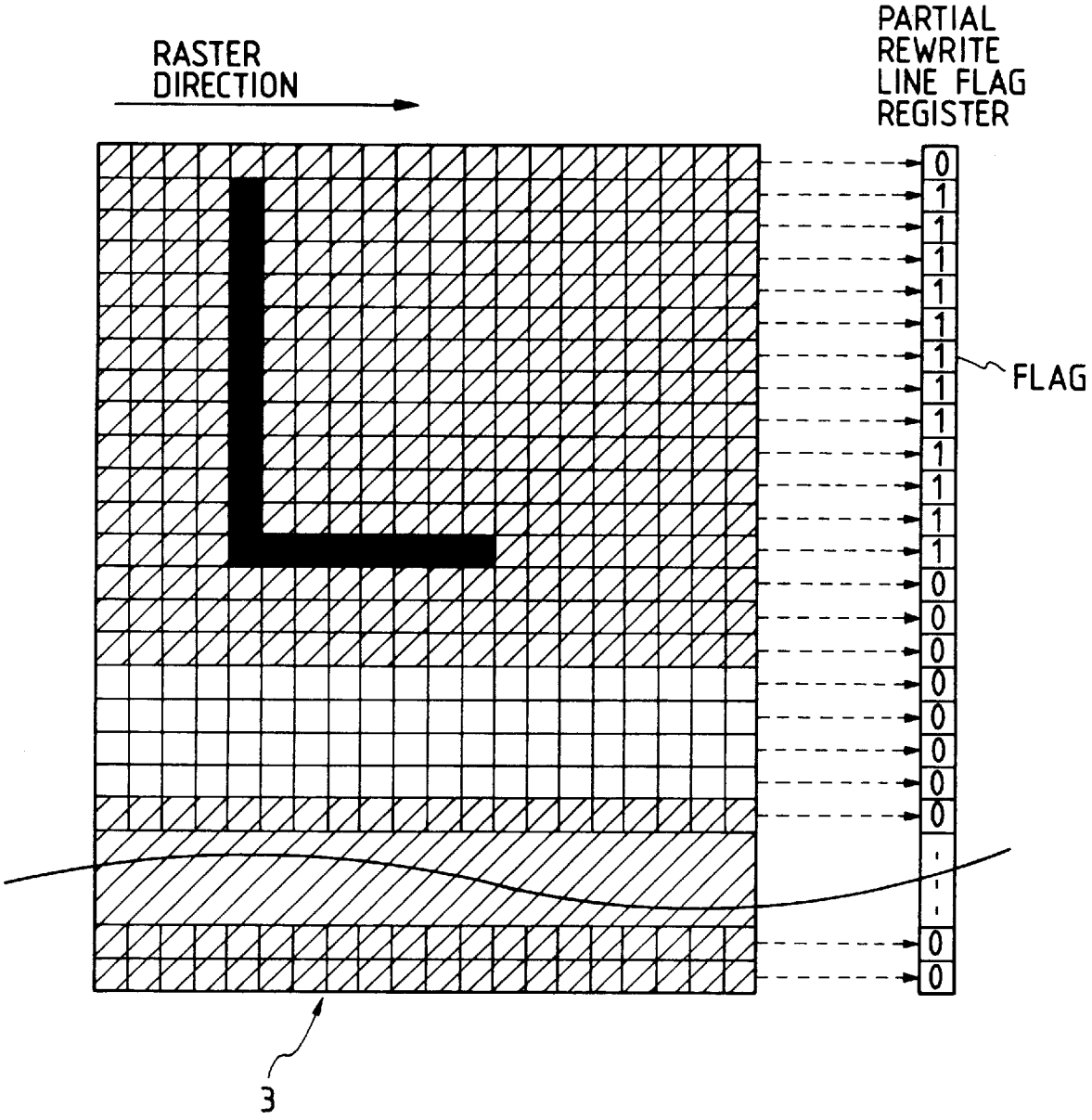
FIG. 6 is a view illustrating a relationship between a rewrite display pixel and a rewrite line flag register according to the first embodiment of the present invention.

As is apparent from FIG. 6, when the address display corresponding to a letter, e.g., "L" in the VRAM 3 is rewritten to display the letter "L", the line address rewritten by the above computation is detected, and a flag is set ("1") in a register corresponding to this address.

The CPU 9 reads the contents of the rewrite line flag register in the rewrite detector/flag generator 5 and sends the line address, the flag of which is set, to the SVGA 1. At this time, the line address generator 7 sends out a line data transfer enable signal corresponding to the line address data and transfers the display data at the above address from the SVGA 1 (of the FIFO 113) to a halftone processor 11.

Figure 7:
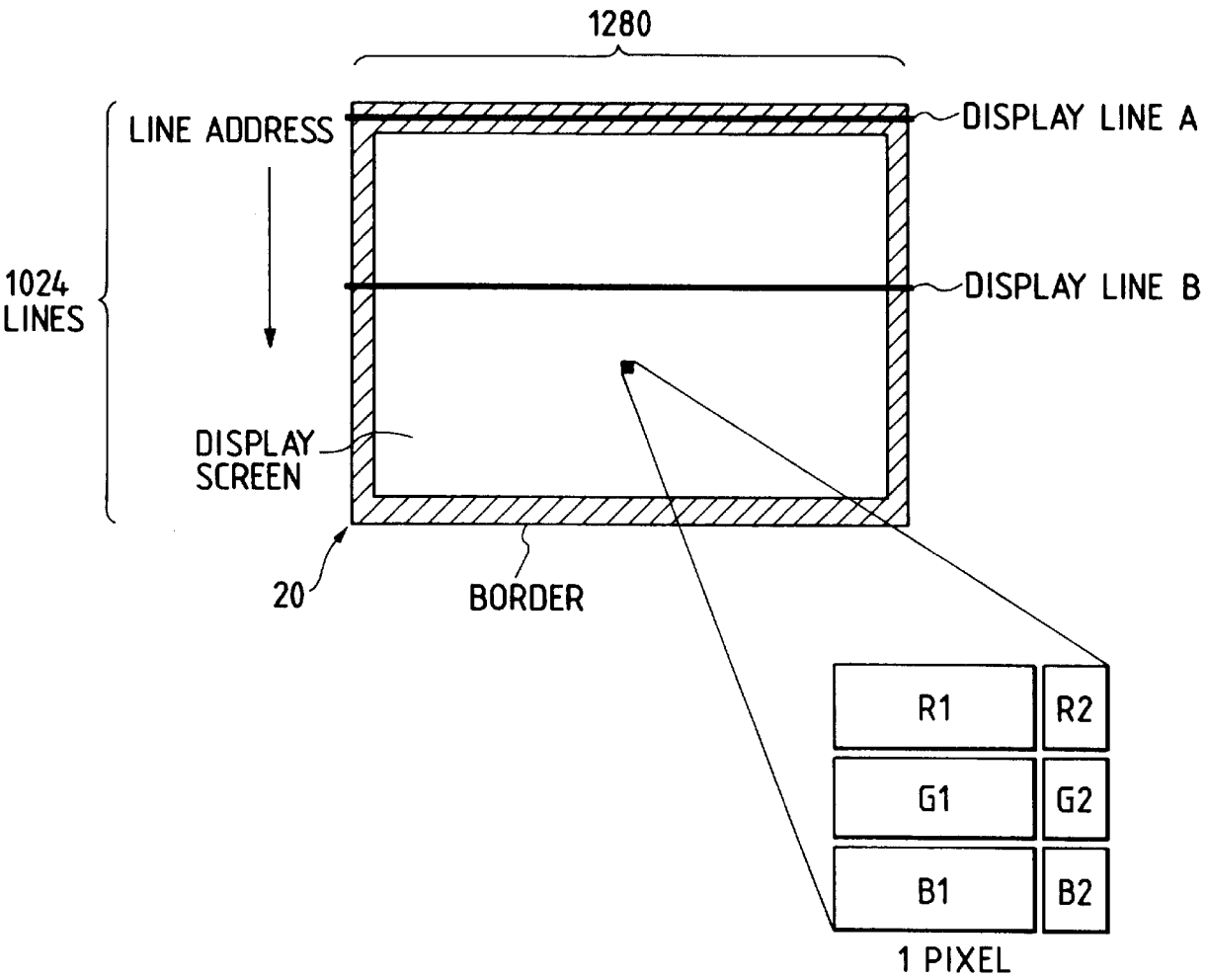
FIG. 7 is a view illustrating an FLCD display screen according to the first embodiment of the present invention.

The halftone processor 11 converts multi-value (256 gradation levels) data expressed by 8-bit R, G, and B data into binary pixel data corresponding to each pixel on the display screen of the FLCD 20. As shown in FIG. 7, one pixel on the display screen has display cells having different areas for the respective colors, and data corresponding to one pixel has two bits for each color (R1, R2, G1, G2, B1, and B2). Therefore, the halftone processor 11 converts 8-bit display data into binary data having two bits for each color (i.e., four-value data for each color).

The schematic data flow until data is converted into FLCD display pixel data as described above is shown in FIG. 9.

Figure 9:
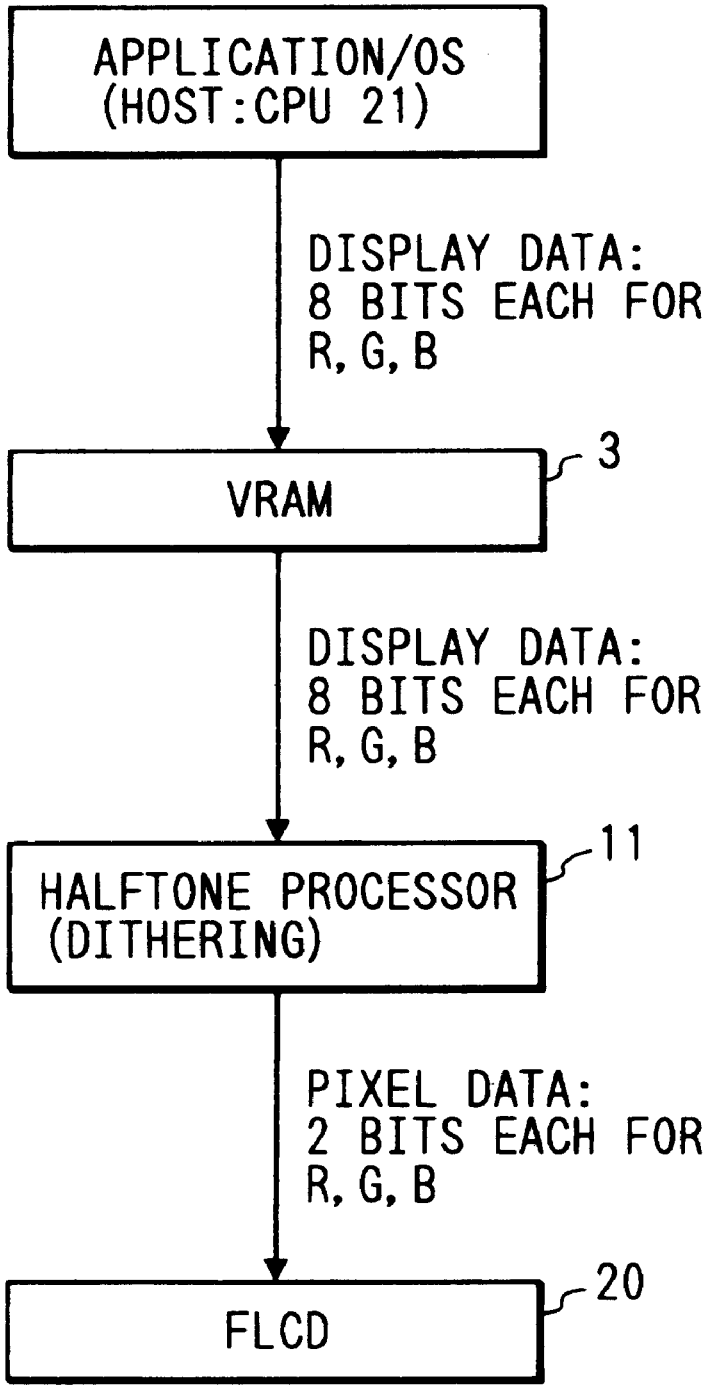
FIG. 9 is a block diagram showing a process flow of display data according to the first embodiment of the present invention.

As is apparent from FIG. 9, display data in the VRAM 3 are stored as 8-bit multi-value data for each of the R, G, and B components. When these data are to be read out and displayed, they are binarized. The host CPU 21 (FIG. 2) can access the FLCD 20 in the same manner as in use of the CRT, thereby assuring compatibility with the CRT.

A technique used in halftone processing can be a known technique such as an error diffusion method, a mean density method, or a dither method.

Referring to FIGS. 3A and 3B, a border generator 13 generates pixel data of a border portion on the display screen of the FLCD. More specifically, as shown in FIG. 7, the display screen of the FLCD 20 has 1,024 lines each consisting of 1,280 pixels. The border portion of the display screen which does not contribute to display is formed to surround the remaining display screen portion.

Figures 8A, 8B:
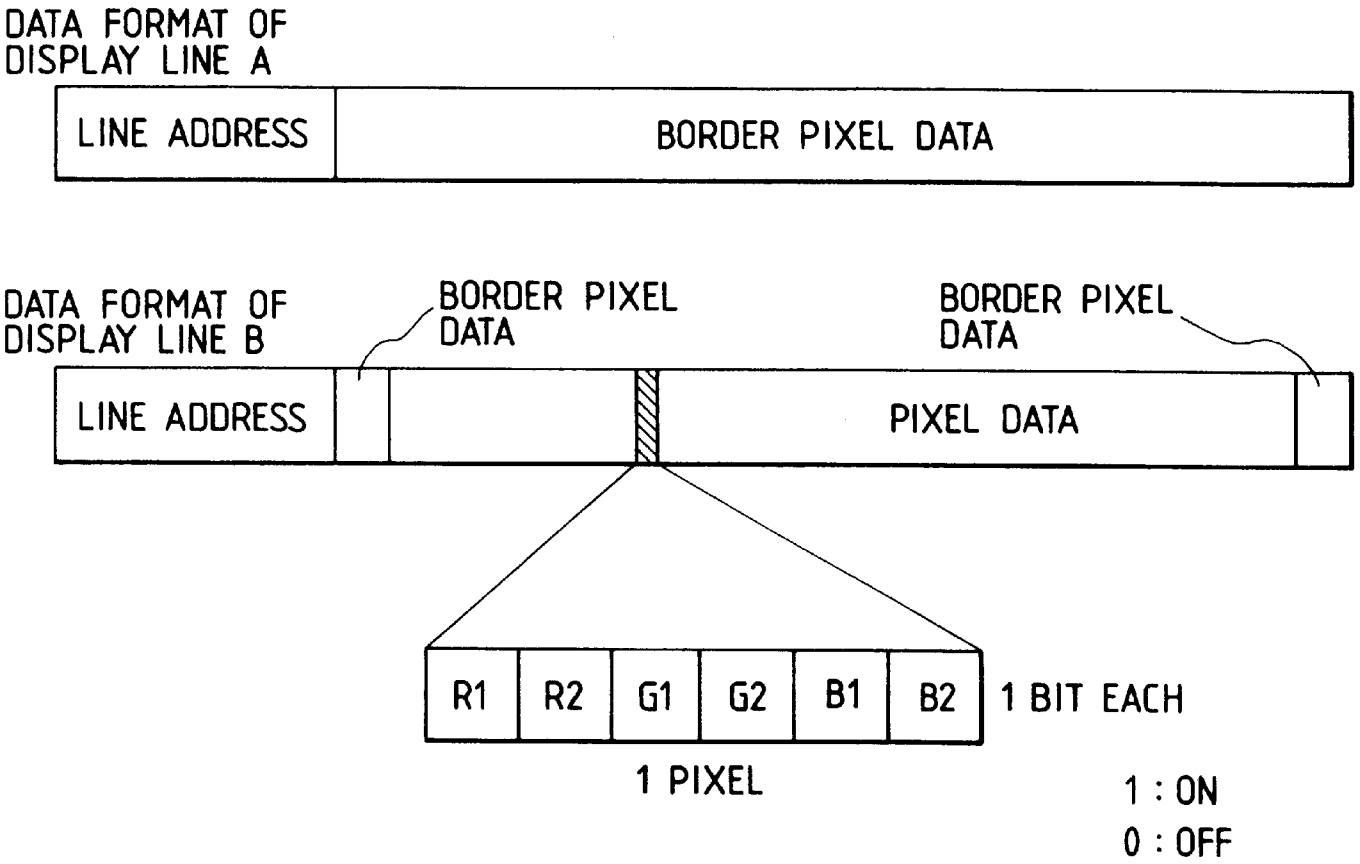
FIGS. 8A and 8B are views illustrating data formats of display data according to the first embodiment of the present invention.

The format of pixel data transferred to the FLCD 20 is defined as the one shown in FIG. 8A or 8B due to the presence of this border portion. FIG. 8A is the data format of a display line A (FIG. 7), i.e., all display lines included in the border portion. FIG. 8B is the data format of a display line B (FIG. 7), i.e., lines used for display. The data format of the display line A starts with a top line address, and border pixel data follows the top line address. To the contrary, since two end portions of the display line B are included in the border portion, its data format starts with a line address, and border pixel data, pixel data, and border pixel data follow the line address in the order named.

The border pixel data generated by the border generator 13 is serially synthesized with pixel data from the halftone processor 11 in a synthesizing circuit 15. The synthesized data is further synthesized with the display line address from the line address generator 7 by a synthesizing circuit 17. The resultant data is sent to the FLCD 20.

The CPU 9 performs the overall operations described above. More specifically, the CPU 9 receives various kinds of information, i.e., the total number of lines of the display screen, the total number of line bits, and the cursor information from the host CPU 21 (FIG. 2). The CPU 9 sends out various data, i.e., the VRAM address offset, the total number of lines, and the total number of line bits to the rewrite detector/flag generator 5 and initializes the line flag register. The CPU 9 also sends out the display start line address, the continuous number of display lines, the total number of lines, the total number of line bits, and border area information to the line address generator 7 and receives partial rewrite line flag information from the line address generator 7. The CPU 9 further sends out data, i.e., a band width, the total number of line bits, and a process mode to the halftone processor 11 and the border pattern data to the border generator 13.

The CPU 9 receives status signals (e.g., temperature information and a Busy signal) from the FLCD 20 and sends out a command signal and a reset signal to the FLCD 20.

Partial rewrite display control of the FLCD I/F 10 described with reference to FIGS. 3A and 3B will be described below.

Figure 10:
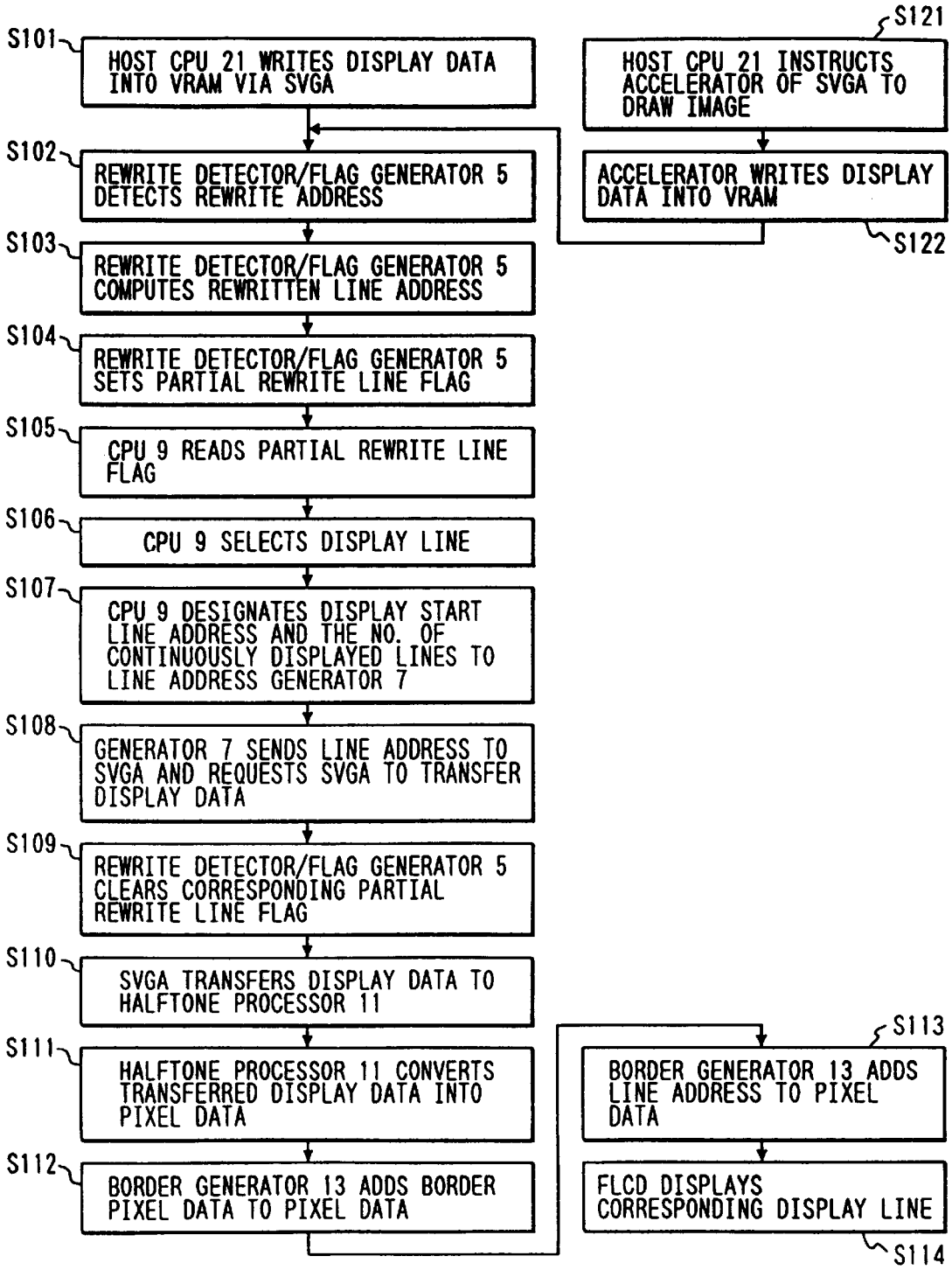
FIG. 10 is a flow chart showing the process flow of the display control apparatus according to the first embodiment of the present invention.
Figure 11:
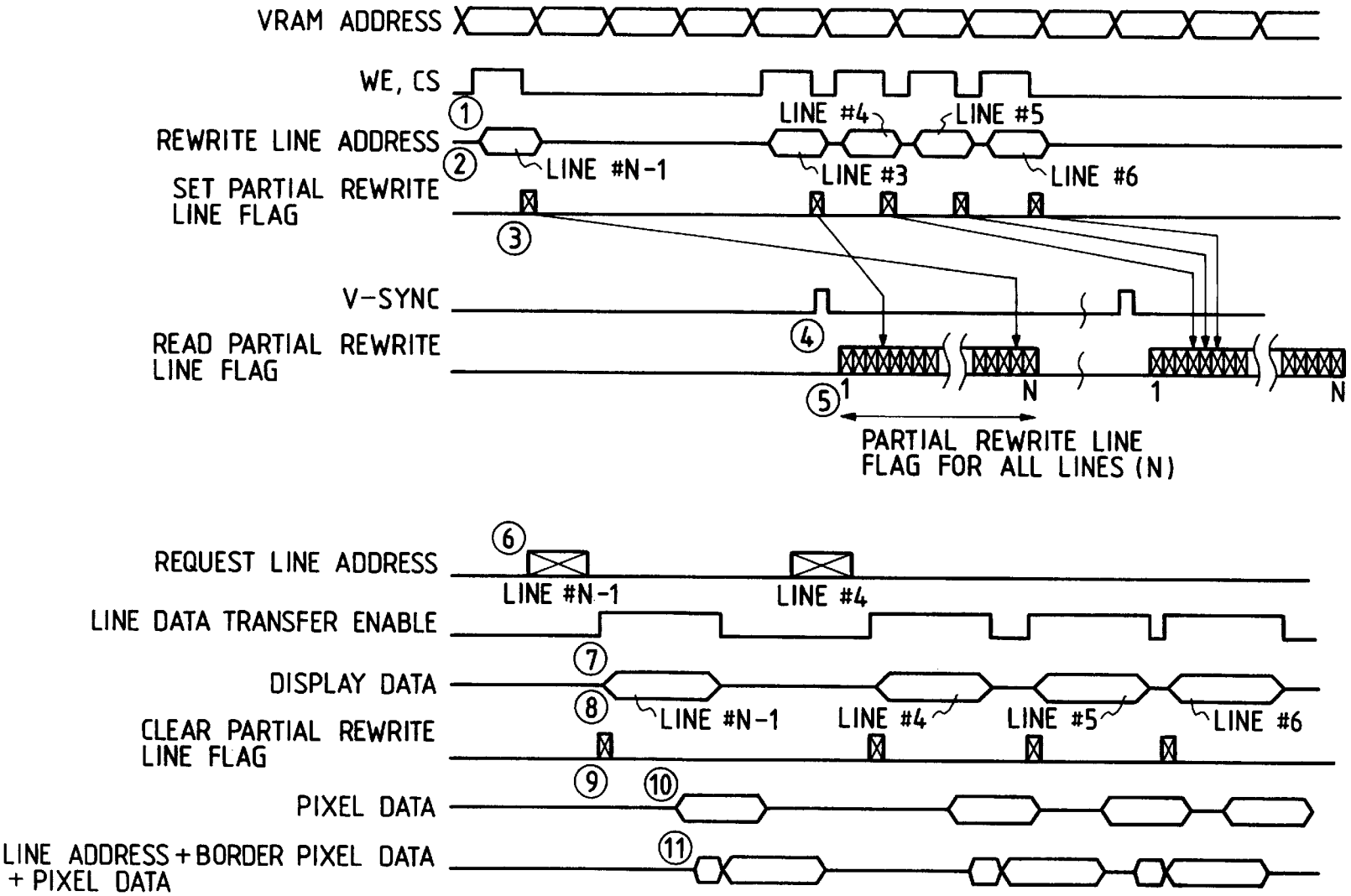
FIG. 11 is a timing chart showing the process of the display control apparatus according to the first embodiment of the present invention.

FIG. 10 is a flow chart showing the flow of a partial rewrite process, and FIG. 11 is a timing chart of the respective signals and data.

Partial rewrite display control will be described with reference to FIGS. 10 and 11.

When the host CPU 21 writes di splay data in the VRAM 3 (step S101 in FIG. 19; only the step numbers are designated hereinafter), or the host CPU 21 sends a drawing instruction to the accelerator of the SVGA 1 (step S121) to cause the accelerator to write the display data in the VRAM 3 (step S122), a write enable signal WE and a chip select signal CS which a re generated by the SVGA 1 are set at "1". The write detector/flag generator 5 detects this (time ① in FIG. 11; only the time is represented hereinafter) to get the rewritten VRAM address. In step S103, a rewrite line address is computed on the basis of this rewrite VRAM address (time ②). In step S104, the rewrite line flag is set (time ③)

The SVGA 1 outputs a signal V-sync to the rewrite detector/flag generator 5 at a predetermined period (time ④), and the rewrite detector/flag generator 5 outputs rewrite line flag information. In step S105, the CPU 9 writes the rewrite line flag information through the line address generator 7 (time ⑤). As is apparent from FIG. 11, the flag set prior to generation of the signal V-sync is read by this signal V-sync.

The CPU 9 selects a display line corresponding to the priority of the cursor information or the like on the basis of the rewrite line flag information sent through the line address generator 7 (step S106). A display start line address and the continuous number of display lines which correspond to this display line are designated to the line address generator 7 (step S107). In response to this, in step S108, the line address generator 7 sends the rewrite line address to the SVGA 1 (time ⑥) and also sends a line data transfer enable signal (time ⑦), thereby requesting display data transfer.

In response to this request, in step S109, the rewrite detector/flag generator which has received the line data transfer enable signal clears a rewrite line flag corresponding to the requested line address (time ⑨), and the SVGA 1 reads out the display data at the requested line address from the VRAM 3. The readout display data is sent to the halftone processor 11 (time ⑧). In step S111, the halftone processor 11 converts the transferred display data into pixel data (time ⑩). In step S112, border pixel data is added to this pixel data. In addition, in step S113, line address data is added to the resultant data (time ⑪) The FLCD 20 displays information on the basis of this rewrite line data (step S114).

As described above, only when the host CPU accesses the VRAM to perform a display rewrite operation, the FLCD I/F serving as the display controller of this embodiment transfers the rewrite line address and the line data transfer enable signal to the SVGA, and the display data can be sent to the FLCD, thereby performing the partial rewrite operation.

The arrangement for causing the SVGA to access the VRAM to read out and transfer the display data only when the line data transfer enable signal is transferred can be obtained by slightly modifying the SVGA as follows.

More specifically, the SVGA 1 has a function of reading out the display data from the VRAM in synchronism with the scan period of the CRT so as to perform CRT display. This function can be performed by an address counter arranged in the SVGA. In this embodiment, the SVGA is modified such that this address counter performs a count-up operation only when the line data transfer enable signal is set at "1".

In the above arrangement using the line data transfer enable signal and the address counter, display control such as refresh control and interface control is performed as follows.

The CPU 9 sets a refresh mode when a predetermined number of read rewrite flags are continuously set. For example, the first line of the FLCD display screen is defined as a display start line address, and the continuous number of display lines is defined as the total number of lines (1,024 lines). Therefore, the line address generator 7 transfers the line data transfer enable signal at the same period as the VRAM read period unique to the SVGA 1.

In an interlace display mode, the number of lines to be interlaced is determined in accordance with temperature information from the FLCD 20 or trimmer information desired by a user. However, when the CPU 9 appropriately sets the above display start line address and the continuous number of display lines to perform interlace display.

The above refresh display can be performed at a predetermined period except that the host CPU accesses the VRAM to perform a rewrite operation. According to this, a slight shift in alignment of the liquid crystal molecules, which is caused by an electric field generated by a common electrode of the FLCD display panel, can be corrected, and a good display state can be maintained.

Second Embodiment

Figures 12, 12A, 12B:
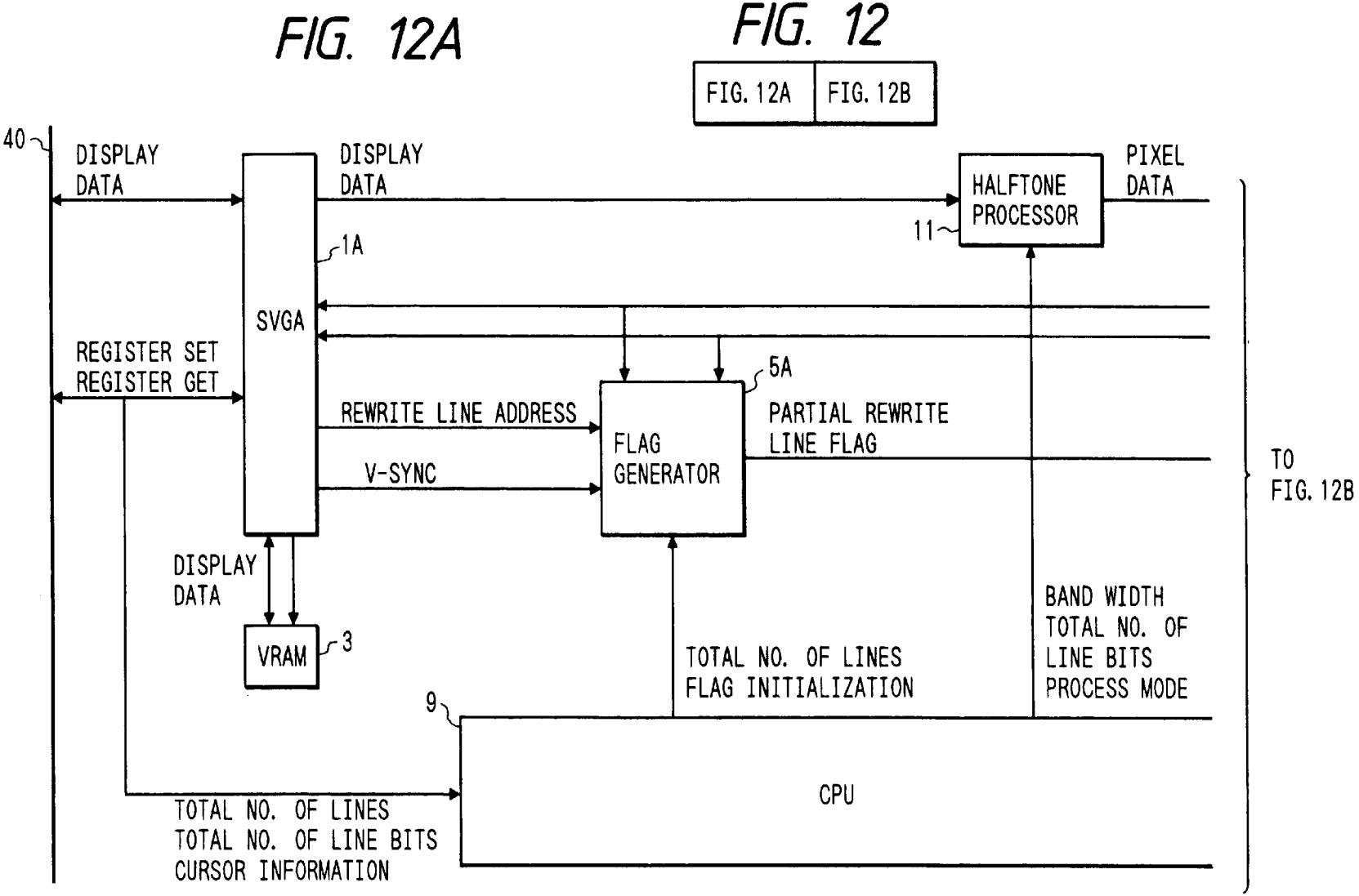
FIG. 12 is comprised of FIGS. 12A and 12B illustrating block diagrams showing a display control apparatus according to the second embodiment of the present invention.
Figure 12B:
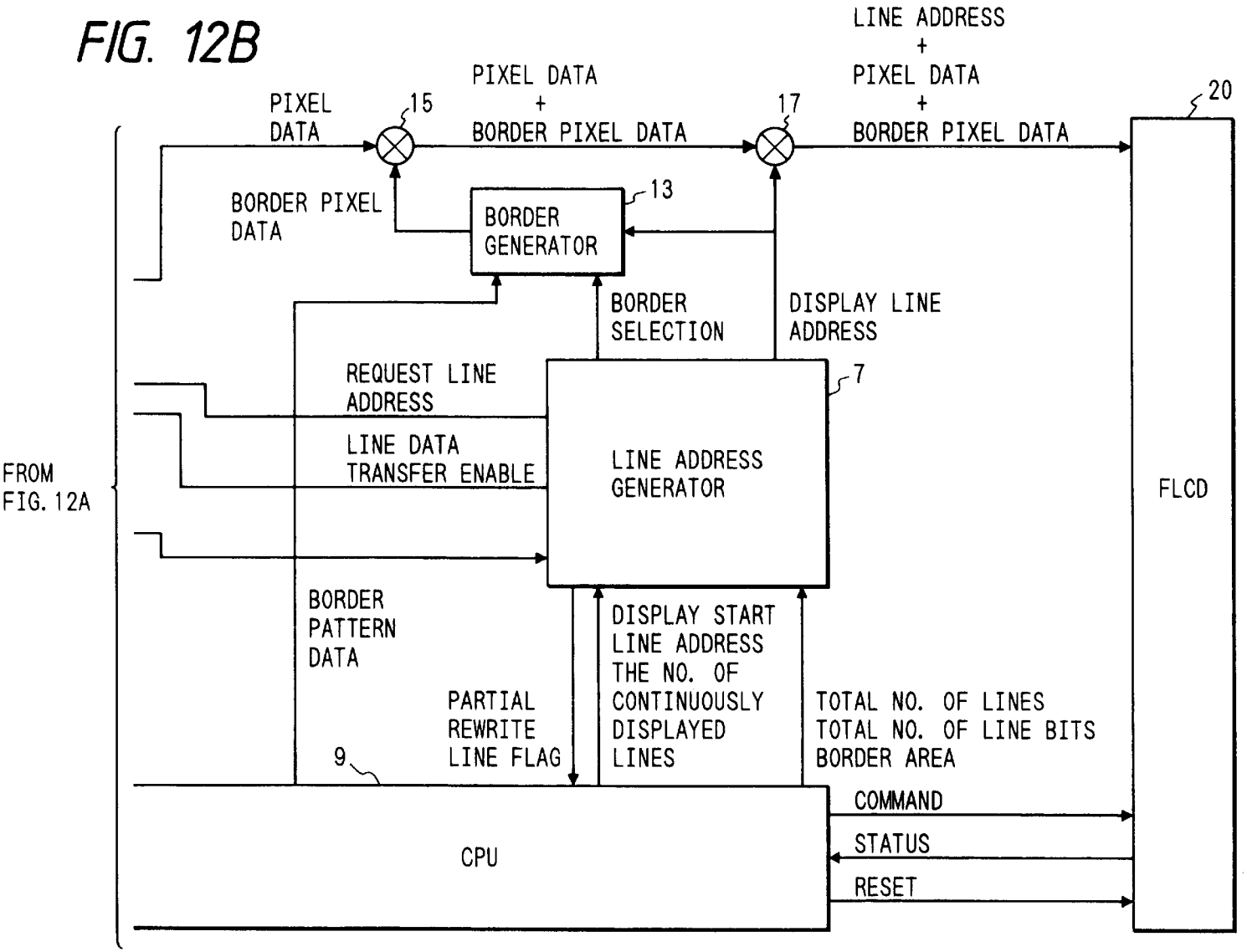
Figure 13:
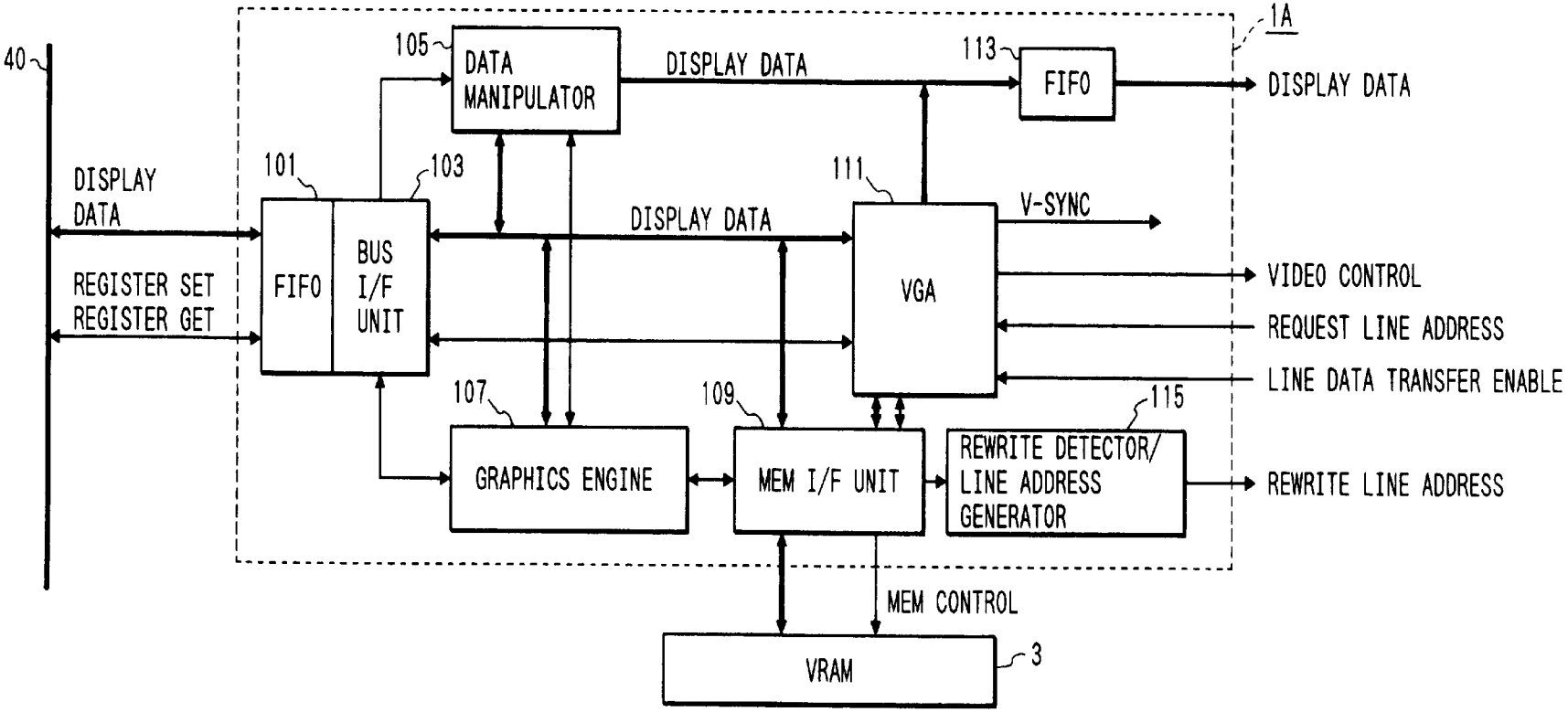
FIG. 13 is a block diagram showing the detailed arrangement of an SVGA shown in FIG. 12A and FIG. 12B.

FIGS. 12A and 12B are block diagrams showing the arrangement of an FLCD I/F according to the second embodiment of the present invention. FIG. 13 is a block diagram showing the detailed arrangement of an SVGA 1A shown in FIGS. 12A and 12B. The same reference numerals as in the first embodiment shown in FIGS. 3A, 3B and 4 denote the same parts in the arrangements shown in FIGS. 12A, 12B and 13, and a detailed description thereof will be omitted.

Figure 14:
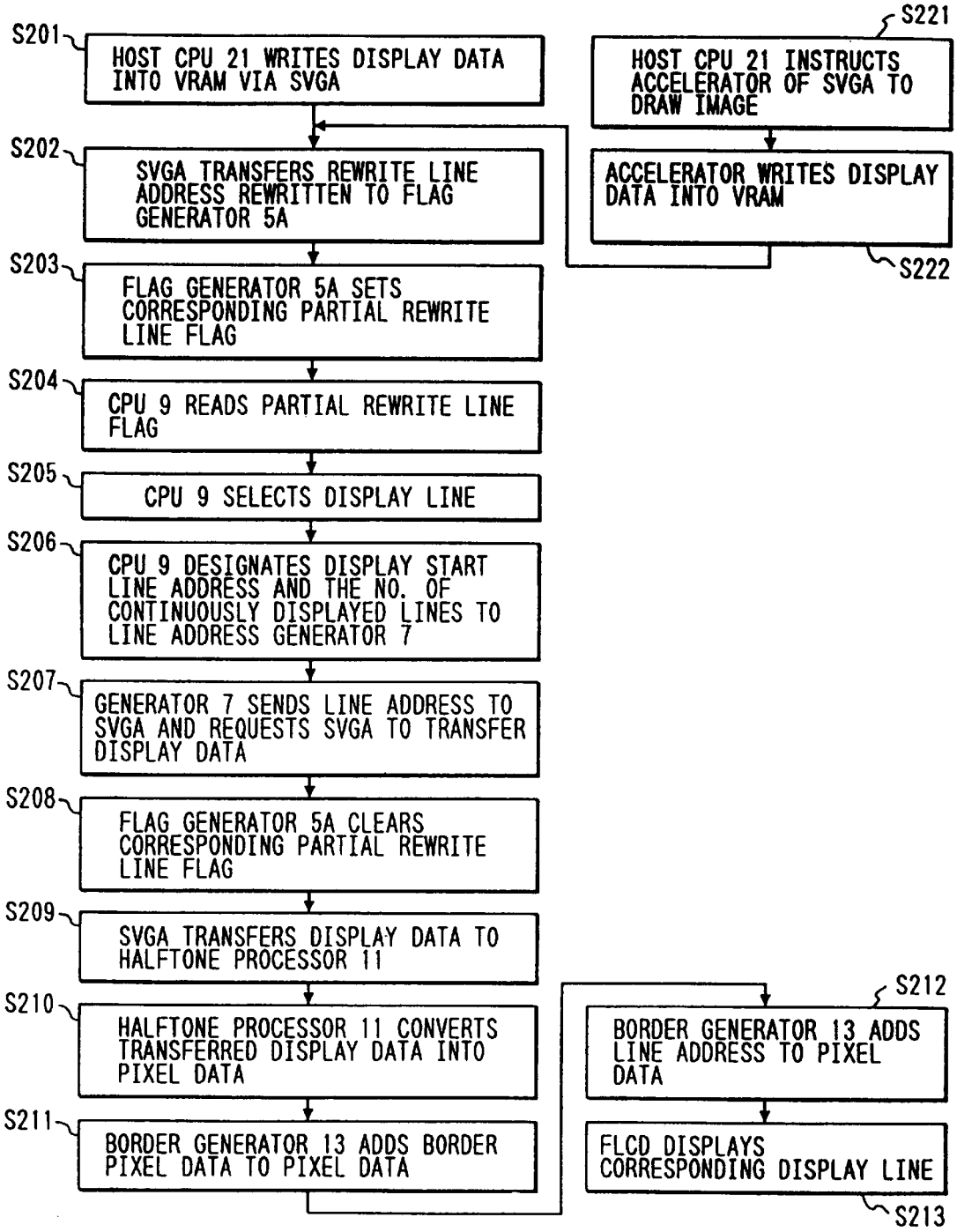
FIG. 14 is a flow chart showing the process flow of the display control apparatus according to the second embodiment.

The second embodiment is different from the first embodiment in that a rewrite detector/line address generator 115 is arranged in the SVGA 1A, and that a flag generator 5A sets a rewrite line flag of a flag register in accordance with a rewrite line address generated by the rewrite detector/line address generator 115 (step S202 in FIG. 14).

With the above arrangement, the number of signal lines for connecting the SVGA 1A and the flag generator 5A can be reduced by the number of control signal lines as compared with the first embodiment.

Third Embodiment

Figures 15, 15A, 15B:
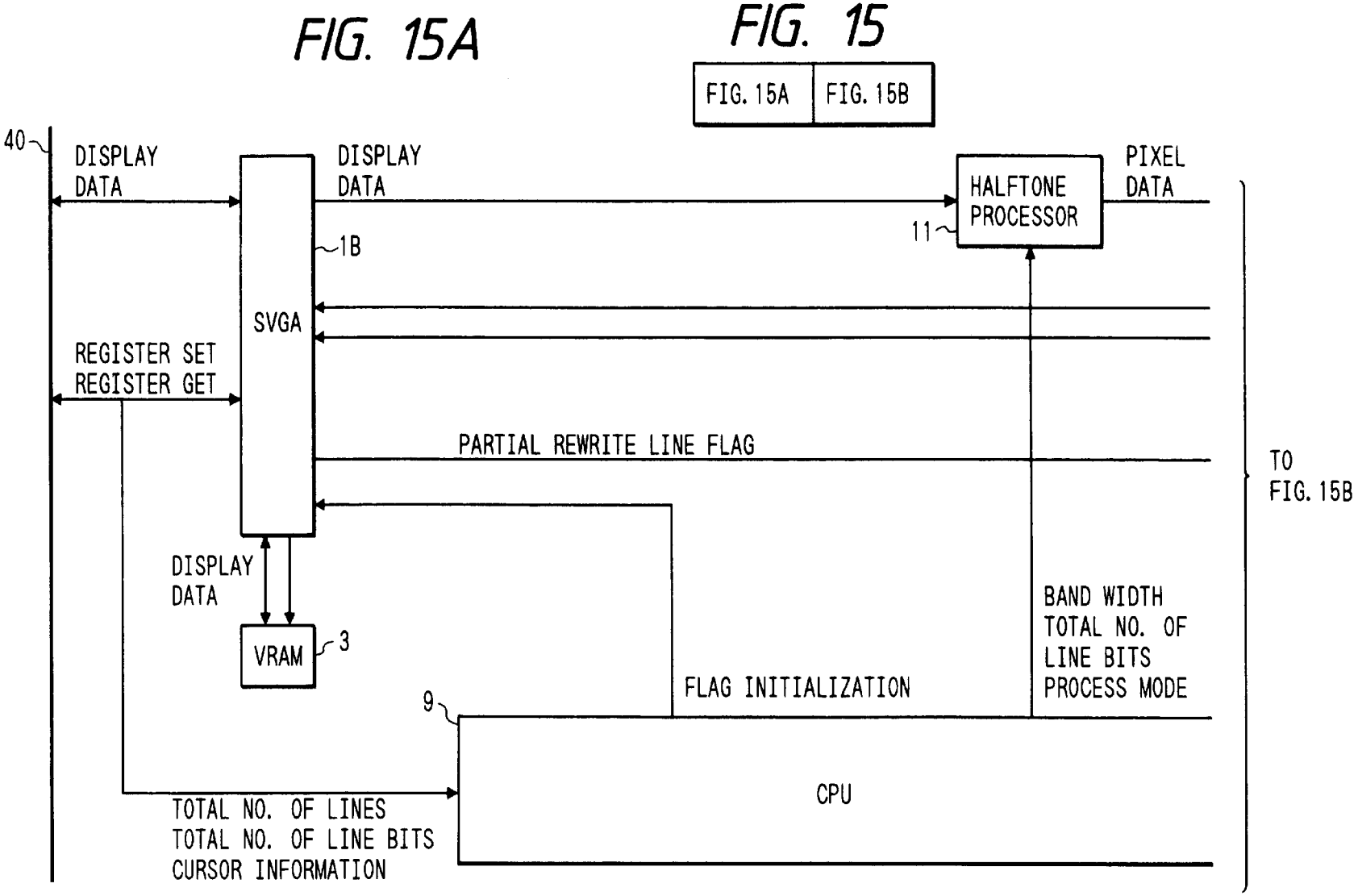
FIG. 15 is comprised of FIGS. 15A and 15B illustrating block diagrams showing a display control apparatus according to the third embodiment of the present invention.
Figure 15B:
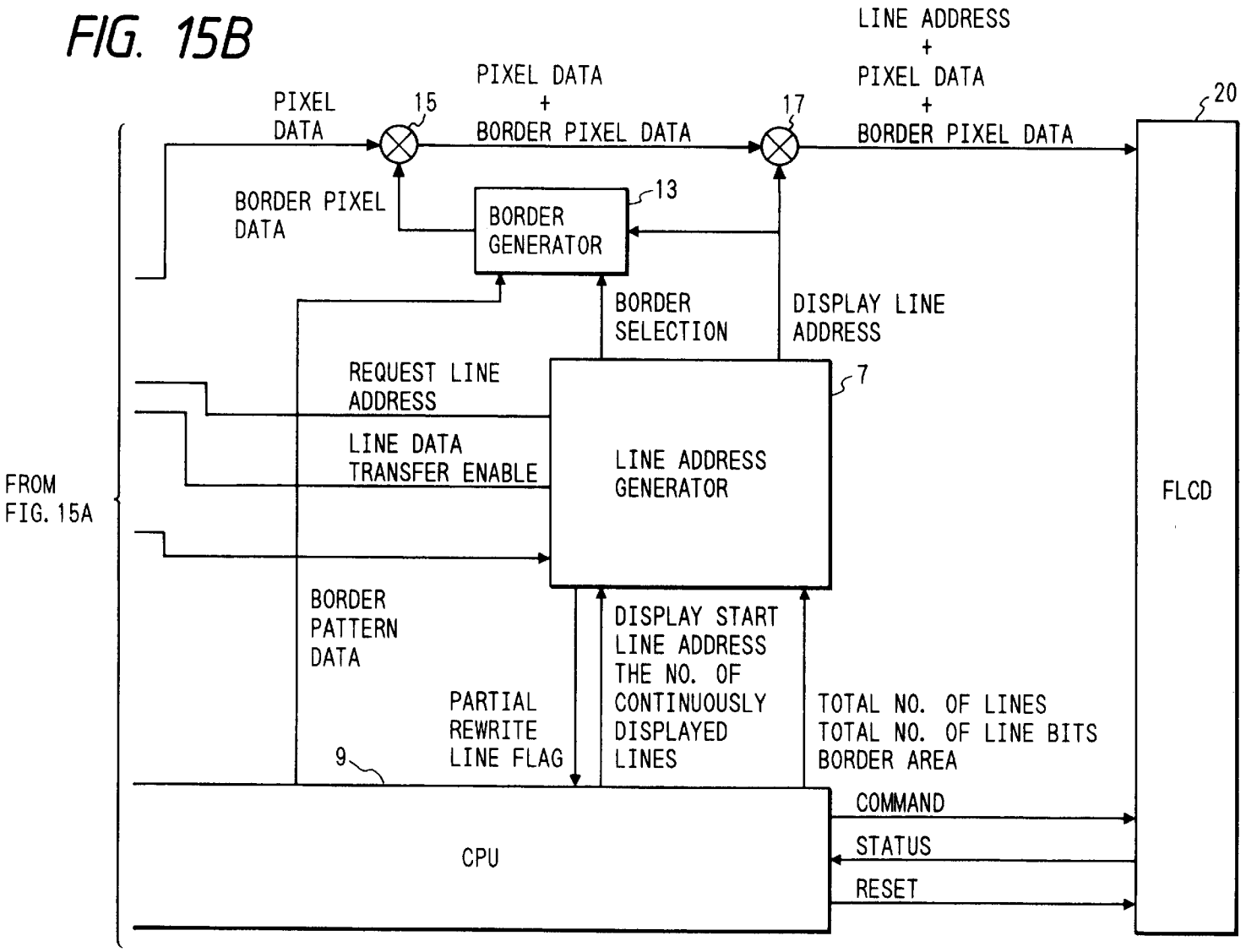
Figure 16:
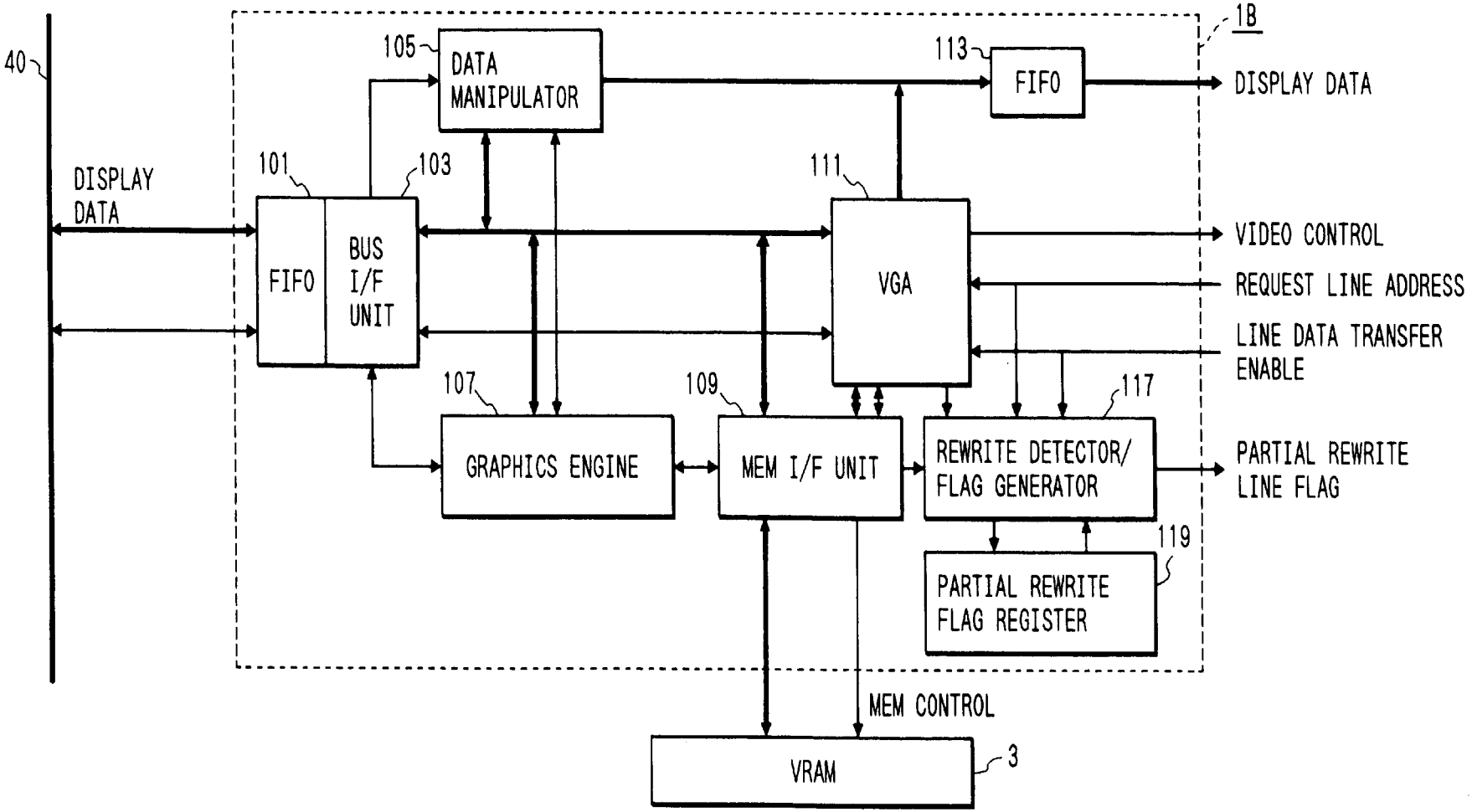
FIG. 16 is a block diagram showing the detailed arrangement of an SVGA shown in FIG. 15A and FIG. 15B.

FIGS. 15A and 15B are block diagrams showing the arrangement of an FLCD I/F according to the third embodiment of the present invention, and FIG. 16 is a block diagram showing the detailed arrangement of an SVGA 1B shown in FIGS. 15A and 15B. The same reference numerals as in the first embodiment shown in FIGS. 3A, 3B and 4 denote the same parts in the arrangements shown in FIGS. 12A, 15B and 16, and a detailed description thereof will be omitted.

Figure 17:
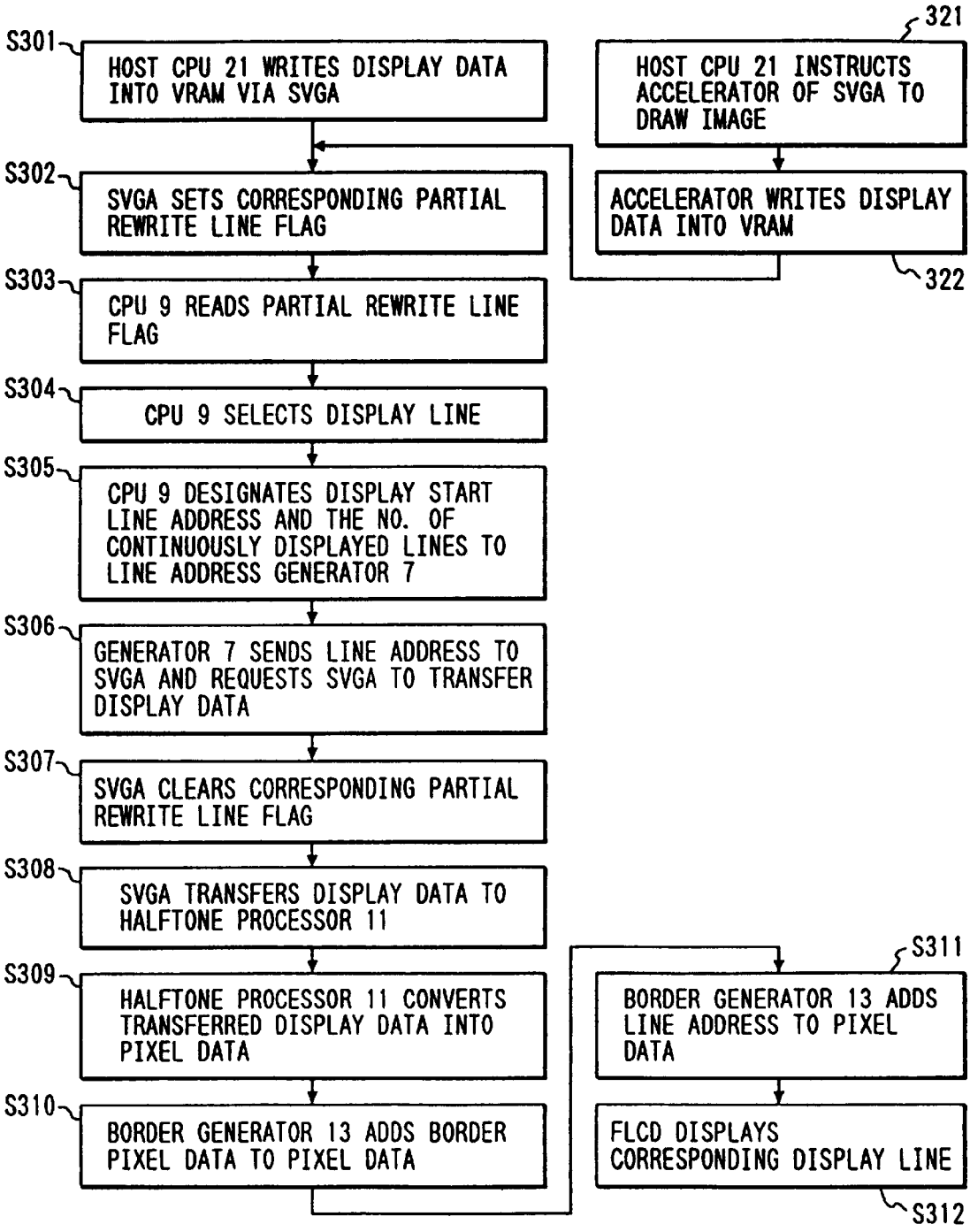
FIG. 17 is a flow chart showing the process flow of the display control apparatus according to the third embodiment.

The third embodiment is different from the first embodiment in that a rewrite detector/flag generator 117 and a rewrite line flag register 119 are arranged in the SVGA 1B. In step S302 in FIG. 17, the SVGA 1B itself finally sets the rewrite line flag, and a CPU 9 can get rewrite line flag information from the SVGA 1B through a line address generator 9.

With the above arrangement, a signal output from the SVGA 1B to the FLCD side is only rewrite line flag information, and the number of signal lines can be further reduced as compared with the second embodiment.

Fourth Embodiment

In each embodiment described above, a host CPU monitors an address for accessing a VRAM to perform a display rewrite operation. A rewrite portion is specified on the basis of this address, and only the specific portion is rewritten.

The operating temperature of the FLCD display element is changed with a change in ambient temperature. In the arrangement of FIGS. 3A and 3B, for example, the speed of the FLCD 20 which receives pixel data and the like and displays information on the basis of the pixel data is changed in accordance with a change in temperature.

For this reason, in this embodiment, for example, in FIGS. 3A and 3B, the FLCD 20 generates a Busy signal as a status signal, and the CPU 9 monitors the period of this Busy signal. The transfer period of the pixel data is determined in accordance with this monitor period. Note that the temperature information may be directly received to change the transfer period on the basis of the temperature information in place of the Busy signal.

Figure 18:
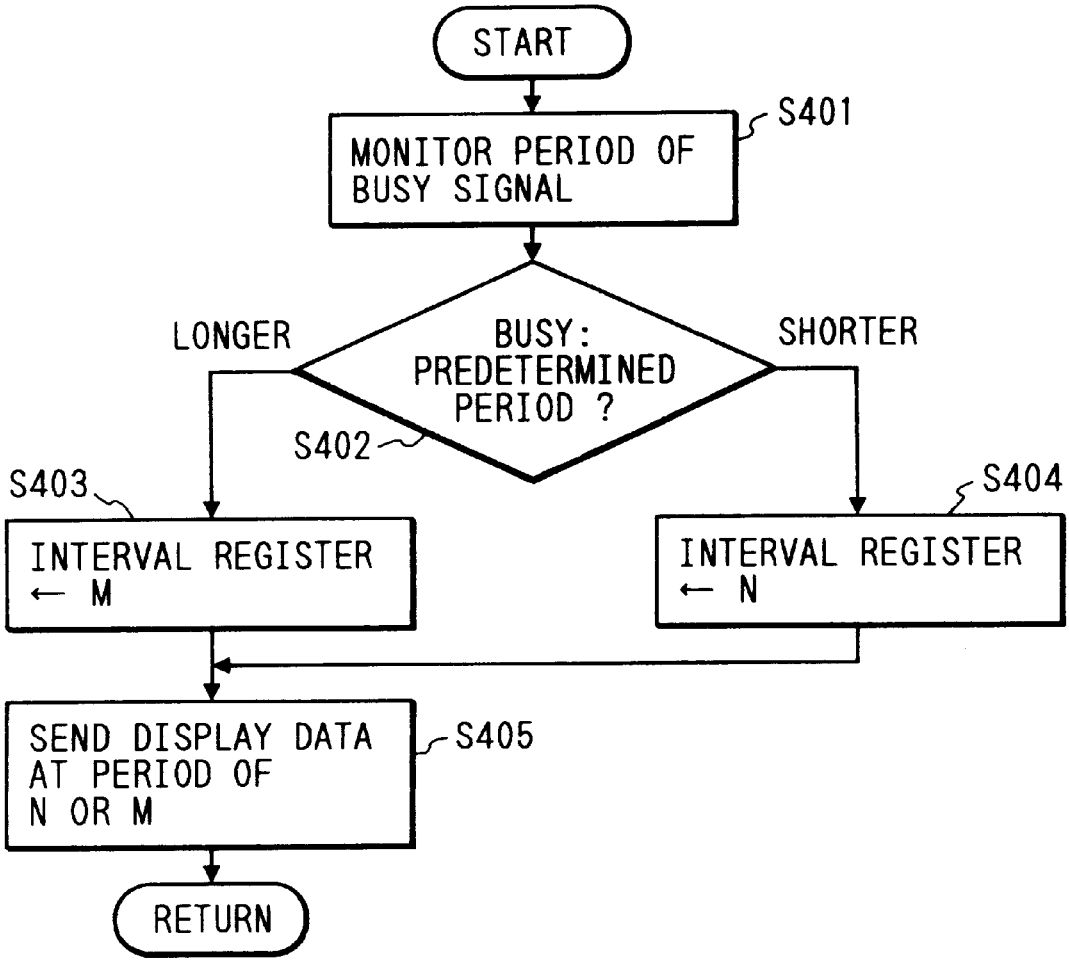
FIG. 18 is a flow chart showing the process flow of a display control apparatus according to the fourth embodiment of the present invention.

FIG. 18 is a flow chart showing the above process.

The period of a Busy signal is received in step S401. It is determined in step S402 whether this period is shorter or longer than a predetermined period. If the received period is longer than the predetermined period, a period M is set in an interval register arranged in, e.g., a line address generator in step S403. However, if the received period is shorter than the predetermined period, a shorter period N is set in step S404. In step S405, display data is transferred from the SVGA 1 at the period M or N. In this case, when the display data is to be transferred at the period M or N, the display data at line addresses corresponding to the flags set in a rewrite flag register during this period must be transferred in accordance with a preferential order. That is, the address generator sends the line address at which a rewrite flag is set, and its data transfer enable signal.

According to this embodiment, the total time required to cause the SVGA to read out the display data from the VRAM and to transfer the readout image data to the FLCD side can be reduced with respect to the total process time of the SVGA. When the FLCD side is to receive display data or the like, the time for waiting for transferring the display data during the period of the Busy signal can be shortened. The SVGA can use process time for writing data in the VRAM and exchanging data with the host CPU. In addition, since the waiting time can be shortened, the line buffer can be reduced.

As can be apparent from the above description, according to the present invention, when the display controller rewrites display data, the address of this display data is detected, and only the display data at the detected address is read out and transferred to the display device by the display controller.

Even if a display controller such as a VGA or SVGA which has a function of reading out and transferring display data at, e.g., the predetermined CRT period is used, a partial rewrite operation in the display device constituted by a ferroelectric liquid crystal can be properly performed.

Fifth Embodiment

In this embodiment, a request line address is sent from a line address generator 7 (see FIGS. 3A and 3B) to an SVGA 1 in units of blocks. The output of this request line address will be described below.

Figure 19:
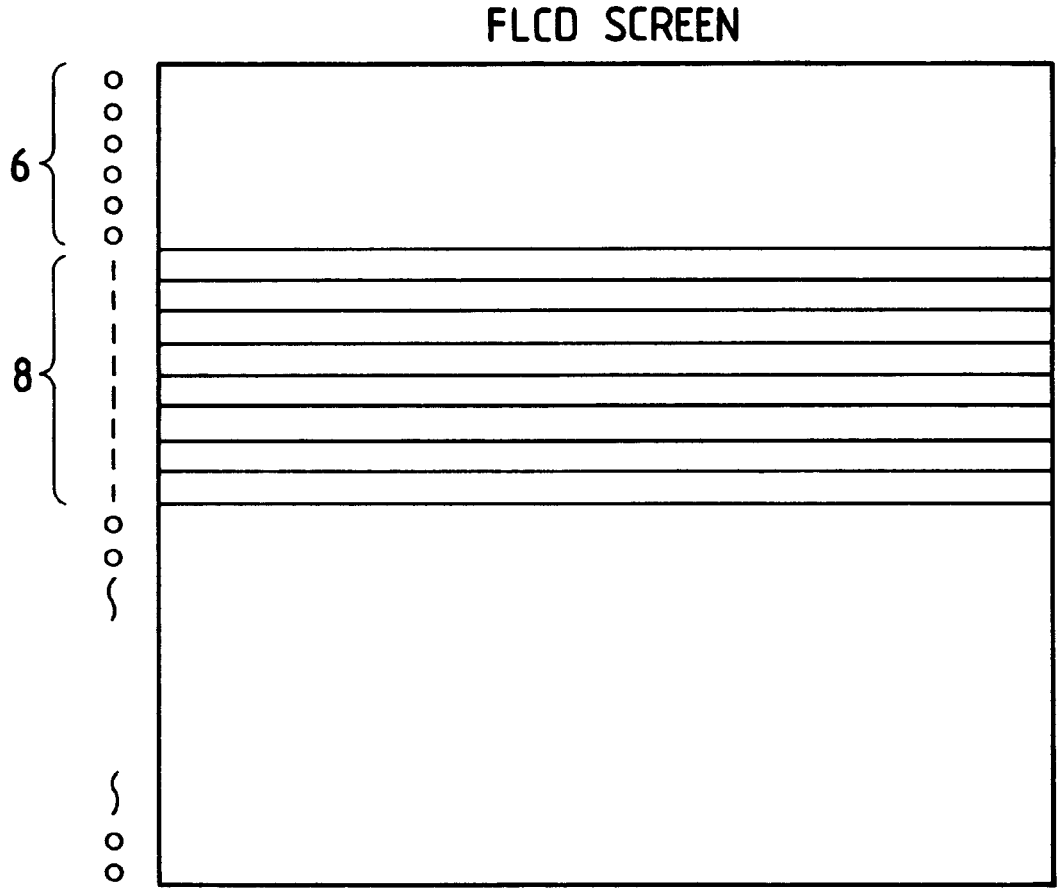
FIG. 19 is a view illustrating an FLCD display screen used to explain the format of line address data according to the fifth embodiment of the present invention.

FIG. 19 is a view illustrating the display screen of an FLCD 20. The six upper lines on the display screen are not rewritten, eight lines from the seventh line can be rewritten, and the subsequent lines are not rewritten.

Figures 20A, 20B:
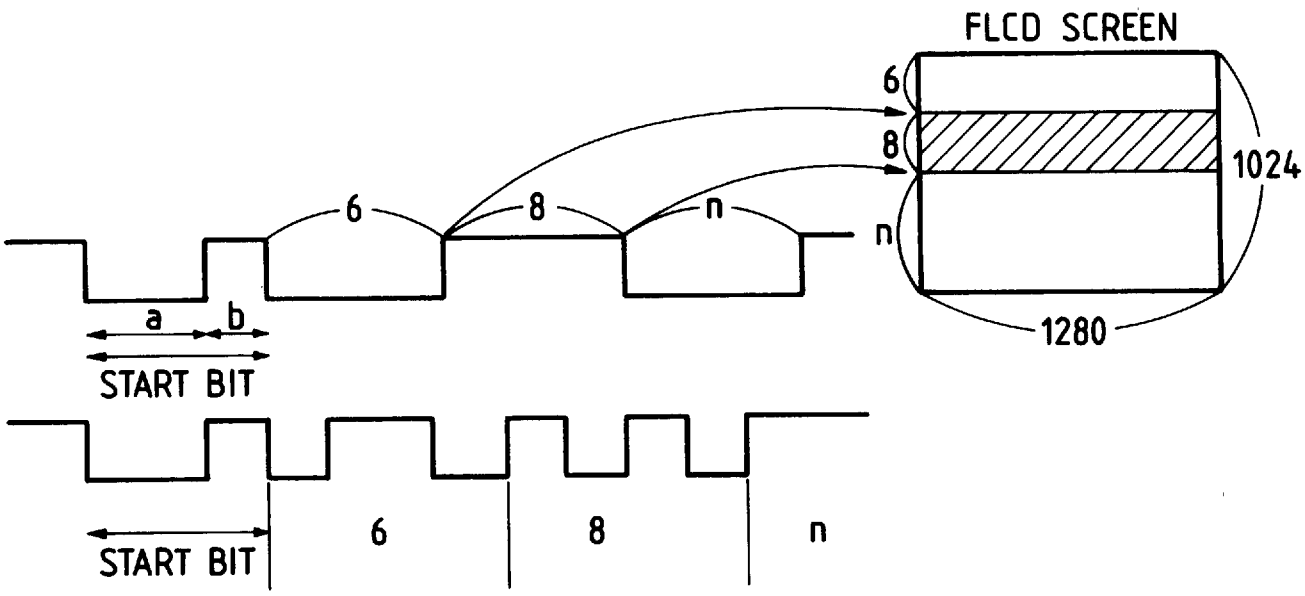
FIGS. 20A and 20B are views showing two data formats, respectively.

In this case, FIG. 20A shows a data format of a request line address transferred from the line address generator 7 to the SVGA 1. As shown in FIG. 20A, this data has start bits representing the start of data. A predetermined number a of bits of the start bits are set at "0"s, and the subsequent predetermined number b of bits are set at "1"s. After the start bits, six bits corresponding to the six lines which are not rewritten are set at "0"s, and eight bits corresponding to the eight lines which can be rewritten are set at "1"s. The subsequent n bits which cannot be rewritten are set at "0"s.

FIG. 20B is a view showing another data format of the request line address shown in FIG. 20A. In this format, after the start bits, codes corresponding to a predetermined number of lines are sent in accordance with a communication scheme. That is, a code corresponding to the six lines which are not rewritten is sent, a code corresponding to eight rewrite lines is sent, and a code corresponding to n lines which are not rewritten is then sent.

More specifically, in this format, the code sent first after the start bits represents the number of lines which are not rewritten, and the number represented by the next code represents the number of lines which are rewritten. Therefore, if a rewrite operation is started from the first line of the FLCD screen, the first code represents zero.

Figures 21A, 21B:
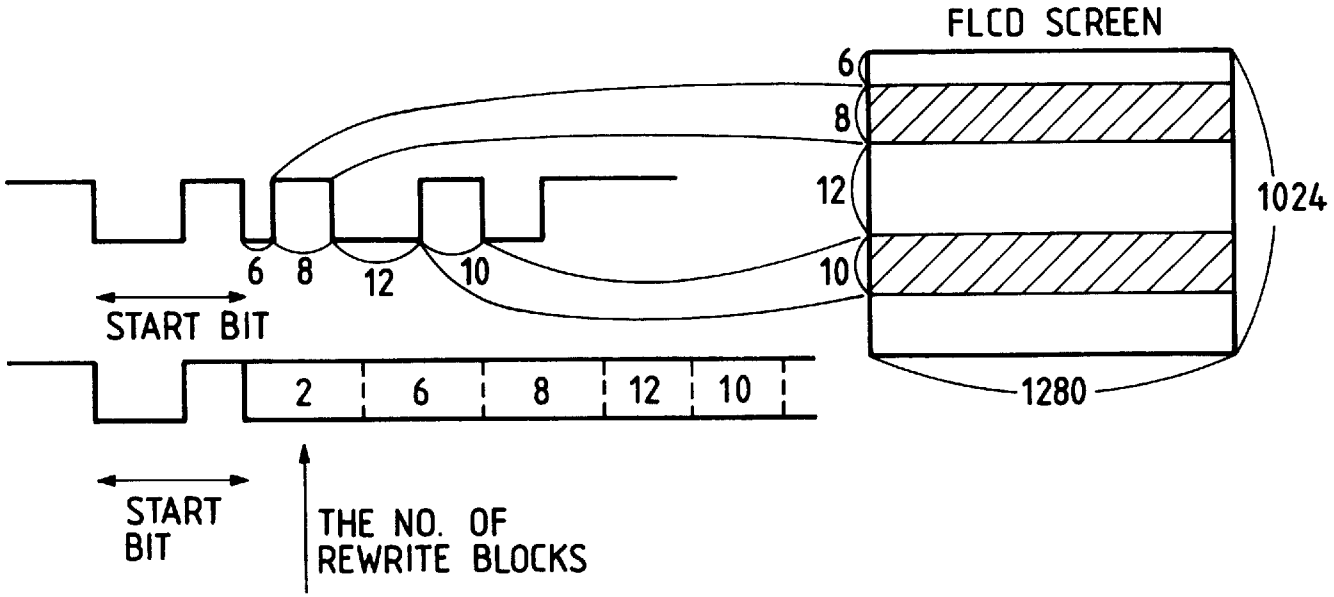
FIGS. 21A and 21B are views for explaining two other data formats.

FIGS. 21A and 21B are formats each having two portions which are to be rewritten on the FLCD screen.

Referring to FIG. 21A, the number of bits of logic "0" represents the number of lines which are not rewritten, and the number of bits of logic "1" represents the number of lines which are rewritten, as in FIG. 20A.

The data format shown in FIG. 21B is similar to that of FIG. 20B. However, the number represented by the first code next to the start bits represents the number of portions which are rewritten, i.e., the number of blocks of rewrite lines. In this embodiment, since two blocks are to be rewritten, a code representing 2 is sent. A code sent next to this code represents the number of lines which are not rewritten on the FLCD screen, and number of "8" represented by the next code represents the number of lines which are rewritten, as in FIG. 20B. Similarly, the next code of "12" represents the number of lines which are not rewritten, and the next code of "10" represents the number of lines which are rewritten.

According to the request line address data formats described above, the following effects can be obtained as compared with a conventional data format.

Figure 22A:
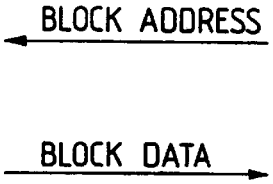
FIGS. 22A and 22B are views for explaining line address transfer of this embodiment and the conventional line address transfer.
Figure 22B:
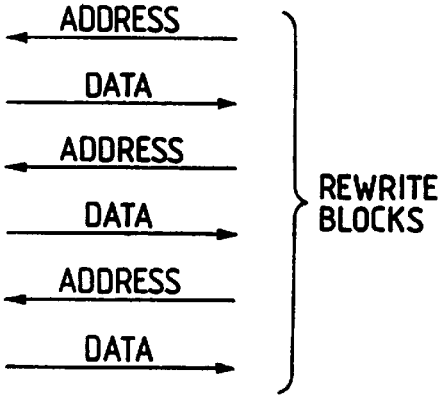
FIG. 22B PRIOR ART

FIGS. 22A and 22B are views for explaining the address request of this embodiment, a conventional address request, and corresponding data transfer states.

In the conventional request shown in FIG. 22B, address data is sent every line to obtain display data of a given rewrite block, and the display data is obtained on the basis of the address data. According to this scheme, an SVGA which has received the address data accesses the VRAM every line to read out the display data. The readout display data is transferred to the FLCD side. A total time from address data generation to display data transfer of all the rewrite lines is relatively prolonged.

To the contrary, according to the data format of this embodiment, as shown in FIG. 22A, all rewrite line address data are sent in units of blocks, and read access and transfer of the display data by the SVGA can be continuously performed in units of blocks. For this reason, as compared with the conventional scheme, a total time from address data generation to display data transfer can be shortened.

As can be apparent from the above description, according to the present invention, when the display controller is permitted to read and transfer display data, the addresses of a plurality of display data in read access can be sent in units of blocks.

As a result, the total time for accessing the display data memory means to read out the display data and transferring the readout data to the display device side can be shortened, thereby providing a display control apparatus having a high process speed.

Sixth Embodiment

Figures 23, 23A, 23B:
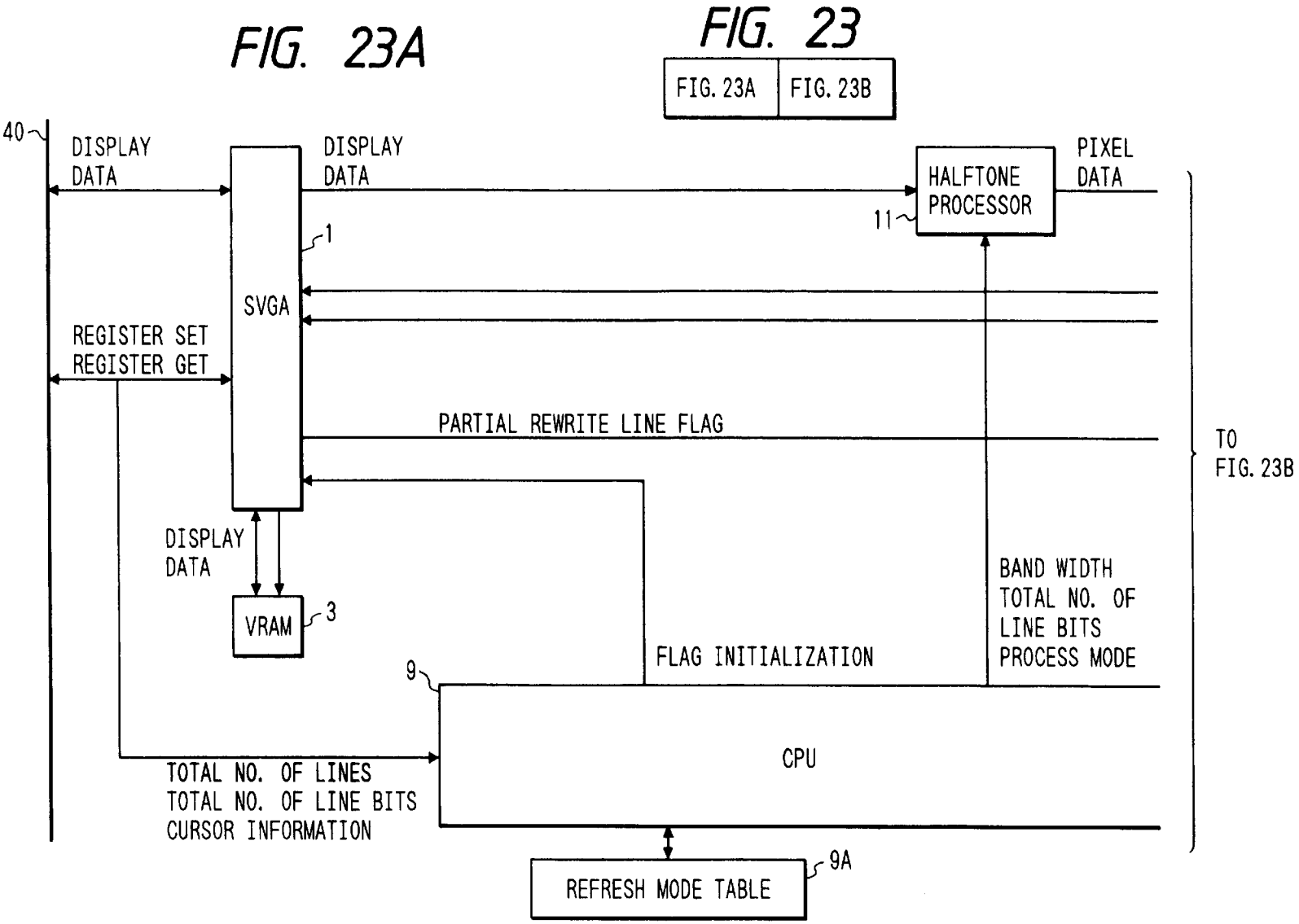
FIG. 23 is comprised of FIGS. 23A and 23B illustrating block diagrams showing a display control apparatus according to the sixth embodiment of the present invention.
Figure 23B:
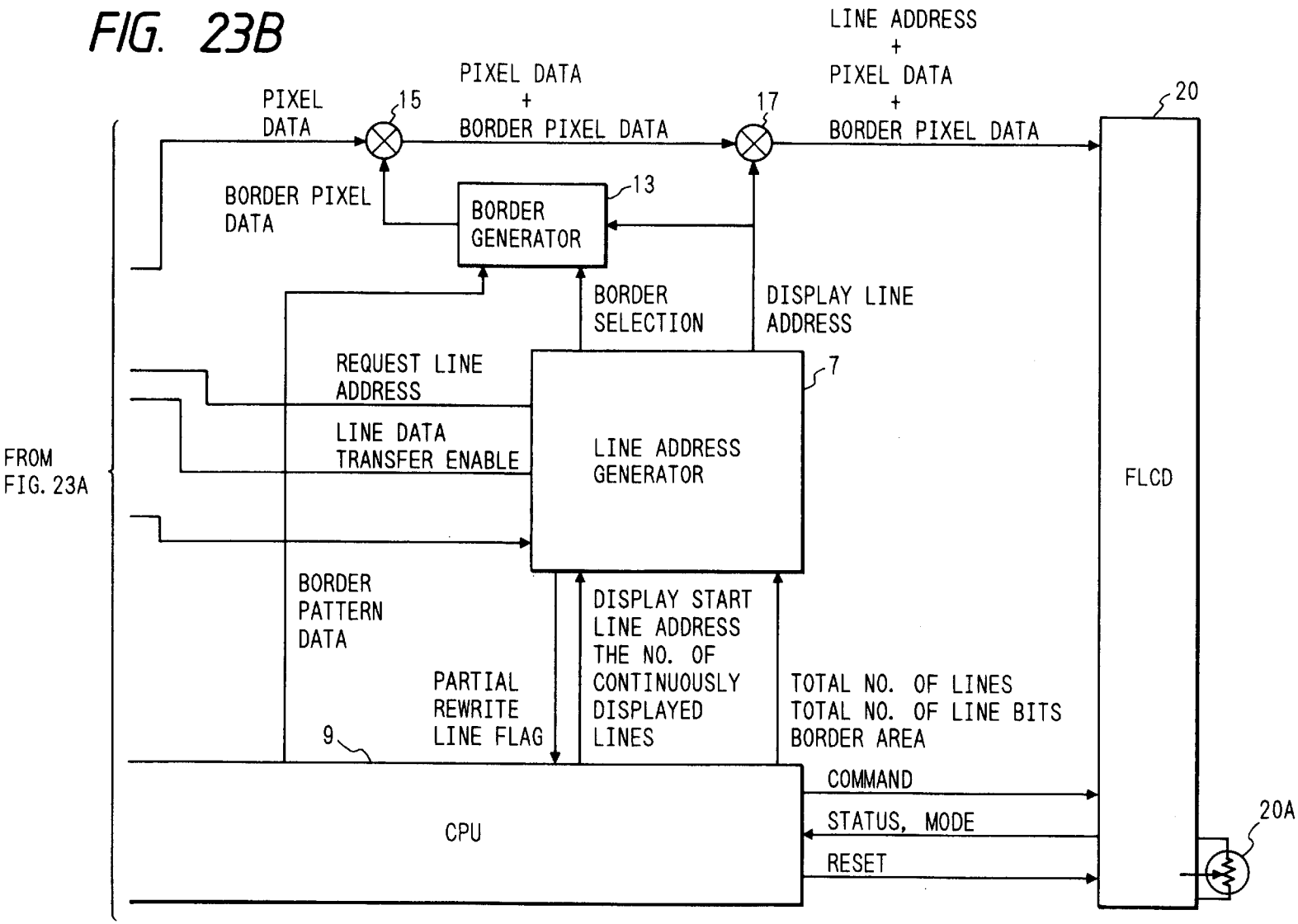

FIGS. 23A and 23B are block diagrams showing the detailed arrangement of an FLCD I/F 10 according to the sixth embodiment of the present invention;

Referring to FIGS. 23A and 23B, an SVGA 1 using the exiting SVGA serving as a CRT display controller is used in the FLCD I/F 10, i.e., the display control apparatus. The arrangement of the SVGA 1 will be described with reference to FIG. 24.

Figure 24:
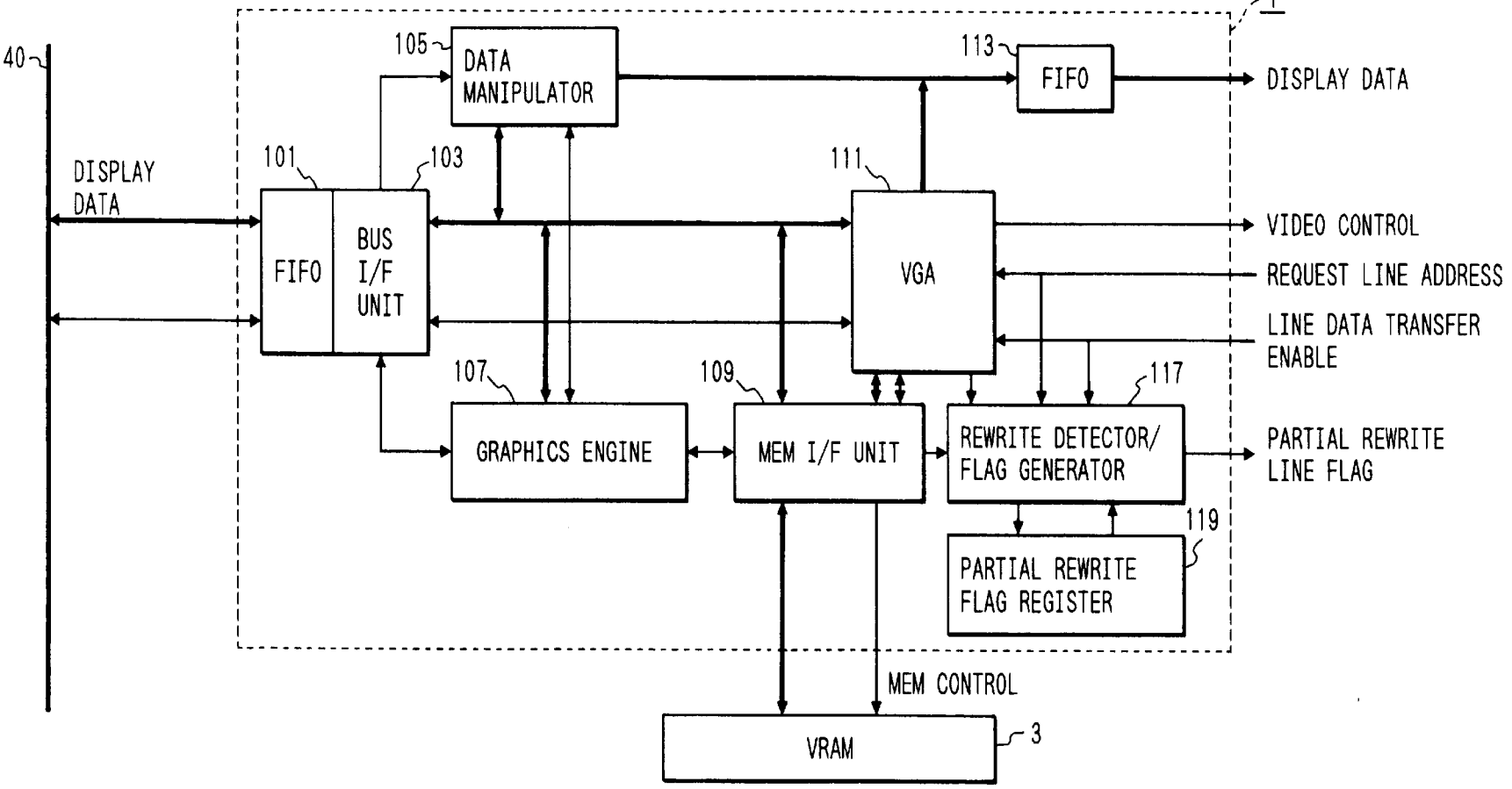
FIG. 24 is a block diagram showing the detailed arrangement of an SVGA shown in FIG. 23A and FIG. 23B.

Referring to FIG. 24, rewrite display data accessed by the host CPU 21 (FIG. 2) to perform a rewrite operation in the display memory window area of the FLCD I/F 10 (FIG. 2) is transferred through the system bus 40 and temporarily stored in a FIFO 101. Bank address data for mapping the display memory window area on an arbitrary area of a VRAM 3 is also transferred through the system bus 40.

Display data has a form of 24 bits for expressing 256 gradation levels for each of the R, G, and B components. Control information such as a command and the bank address data from the CPU 21 is transferred in the form of register set data. Register get data for allowing the CPU 21 to detect the state on the SVGA side is transferred to the CPU 21. The register set data and the display data which are stored in the FIFO 101 are sequentially input, so that the registers in a bus I/F unit 103 and a VGA 111 are set in accordance with the output data. The VGA can know a bank address, its display data, and a control command in accordance with the set states of these registers.

The VGA 111 generates a VRAM address for the VRAM 3 on the basis of the address of the display memory window area and the bank address. At the same time, the VGA 111 transfers strobe signals RAS and CAS, a chip select signal CS, and a write enable signal WE, all of which serve as memory control signals, to the VRAM 3 through a memory I/F unit 109, thereby writing the display data at a position designated by the VRAM address. At this time, the display data to be rewritten is transferred to the VRAM 3 through the memory I/F unit 109.

On the other hand, in response to a line data transfer enable signal transferred from a line address generator 7 (FIGS. 23A and 23B), the VGA 111 reads out the display data from the VRAM 3 which is specified by a request line address transferred from the line address generator 7. The VGA 111 then stores the readout data in a FIFO 113. The display data is sent from the FIFO 113 to the FLCD side in the display data storage order.

The SVGA 1 comprises a data manipulator 105 and a graphics engine 107, both of which provide the accelerator function as previously described, in addition to the cursor display circuit. For example, when the CPU 21 sets data associated with a circle, its center, and its radius in the registers of the bus I/F unit 103 to instruct drawing of the circle, the graphics engine 107 generates circle display data, and the data manipulator 105 writes the resultant data in the VRAM 3.

A rewrite detector/flag generator 117 monitors a VRAM address generated by the SVGA 111 and fetches a VRAM address upon rewriting (writing) of the display data of the VRAM 3, i.e., a VRAM address obtained when the write enable signal and the chip select signal CS go to level "1". The rewrite detector/flag generator 5 calculates a line address on the basis of this VRAM address and data (i.e., a VRAM address offset, the total number of lines, and the total number of line bits) obtained from a CPU 9. The concept of this computation is shown in FIG. 5.

A circuit (to be described later) for generating an interlace line address corresponding to an interlace value from the CPU 9 is arranged in part of the rewrite detector/flag generator 117.

As shown in FIG. 5, a pixel represented by an address X in the VRAM 3 corresponds to a line N on the FLCD screen. One line comprises a plurality of pixels, and each pixel is constituted by a plurality (n) of bytes. At this time, the line address (line number N) is computed as follows.

$$\text{Line No. } N = \frac{(VRAM\ \text{Address}\ X) - (\text{Image Data Start Address})}{(\text{Number of Pixels per Line}) \times (\text{Number of Bytes per Pixel})} + 1$$

The rewrite detector/flag generator 117 sets the flag of its internal partial rewrite line flag register 119 in accordance with the computed line address. This state is shown in FIG. 6.

As is apparent from FIG. 6, when the address display corresponding to a letter, e.g., "L" in the VRAM 3 is rewritten to display the letter "L", the line address rewritten by the above computation is detected, and a flag is set ("1") in a register corresponding to this address.

Referring back to FIGS. 23A and 23B, the CPU 9 reads the contents of the rewrite line flag register in the rewrite detector/flag generator 117 and sends the line address, the flag of which is set, to the SVGA 111. At this time, the line address generator 117 sends out a line data transfer enable signal corresponding to the line address data and transfers the display data at the above address from the SVGA 111 (of the FIFO 113) to a halftone processor 11.

The halftone processor 11 converts multi-value (256 gradation levels) data expressed by 8-bit R, G, and B data into binary pixel data corresponding to each pixel on the display screen of the FLCD 20. As shown in FIG. 7, one pixel on the display screen has display cells having different areas for the respective colors, and data corresponding to one pixel has two bits for each color (R1, R2, G1, G2, B1, and B2). Therefore, the halftone processor 11 converts 8-bit display data into binary data having two bits for each color (i.e., four-value data for each color).

The schematic data flow until data is converted into FLCD display pixel data as described above is shown in FIG. 9.

As is apparent from FIG. 9, display data in the VRAM 3 are stored as 8-bit multi-value data for each of the R, G, and B components. When these data are to be read out and displayed, they are binarized. The host CPU 21 (FIG. 2) can access the FLCD 20 in the same manner as in use of the CRT, thereby assuring compatibility with the CRT.

A technique used in halftone processing can be a known technique such as an error diffusion method, a mean density method, or a dither method.

Referring to FIGS. 23A and 23B, a border generator 13 generates pixel data of a border portion on the display screen of the FLCD. More specifically, as shown in FIG. 7, the display screen of the FLCD 20 has 1,024 lines each consisting of 1,280 pixels. The border portion of the display screen which does not contribute to display is formed to surround the remaining display screen portion.

The format of pixel data transferred to the FLCD 20 is defined as the one shown in FIG. 8A or 8B due to the presence of this border portion. FIG. 8A is the data format of a display line A (FIG. 7), i.e., all display lines included in the border portion. FIG. 8B is the data format of a display line B (FIG. 7), i.e., lines used for display. The data format of the display line A starts with a top line address, and border pixel data follows the top line address. To the contrary, since two end portions of the display line B are included in the border portion, its data format starts with a line address, and border pixel data, pixel data, and border pixel data follow the line address in the order named.

The border pixel data generated by the border generator 13 is serially synthesized with pixel data from the halftone processor 11 in a synthesizing circuit 15. The synthesized data is further synthesized with the display line address from the line address generator 7 by a synthesizing circuit 17. The resultant data is sent to the FLCD 20.

The CPU 9 performs the overall operations described above. More specifically, the CPU 9 receives various kinds of information, i.e., the total number of lines of the display screen, the total number of line bits, and the cursor information from the host CPU 21 (FIG. 2). The CPU 9 sends out various data, i.e., the VRAM address offset, the total number of lines, and the total number of line bits to the rewrite detector/flag generator 117 and initializes the line flag register. The CPU 9 also sends out the display start line address, the continuous number of display lines, the total number of lines, the total number of line bits, and border area information to the line address generator 7 and receives partial rewrite line flag information from the line address generator 7. The CPU 9 further sends out data, i.e., a band width, the total number of line bits, and a process mode to the halftone processor 11 and the border pattern data to the border generator 13.

The CPU 9 receives status signals (e.g., temperature information, trimmer information, and a Busy signal) from the FLCD 20 and sends out a command signal and a reset signal to the FLCD 20. In addition, interlace refresh display control (to be described later) is performed with reference to a refresh mode table 9A.

Interlace refresh display control by the FLCD I/F 10 described with reference to FIGS. 23A, 23B and 24 will be described below.

FIG. 25 is a view illustrating the refresh mode table shown in FIGS. 23A and 23B.

The refresh display is started when a partial rewrite operation is not performed within a predetermined period of time. A ratio of partial rewriting to refreshing shown in FIG. 25 is determined in accordance with the above interlace value. In the table, the interlace value, i.e., the number of lines to be interlaced, is obtained with reference to the temperature information and the trimmer information from the FLCD 20.

In general, when the temperature of the FLCD 20 is high and its operating speed is high, the refresh ratio is increased with a small interlace value. To the contrary, when the temperature is low and the operating speed is also low, the partial rewrite ratio is high with a relatively interlace value. The table is set as described above.

Figure 26:
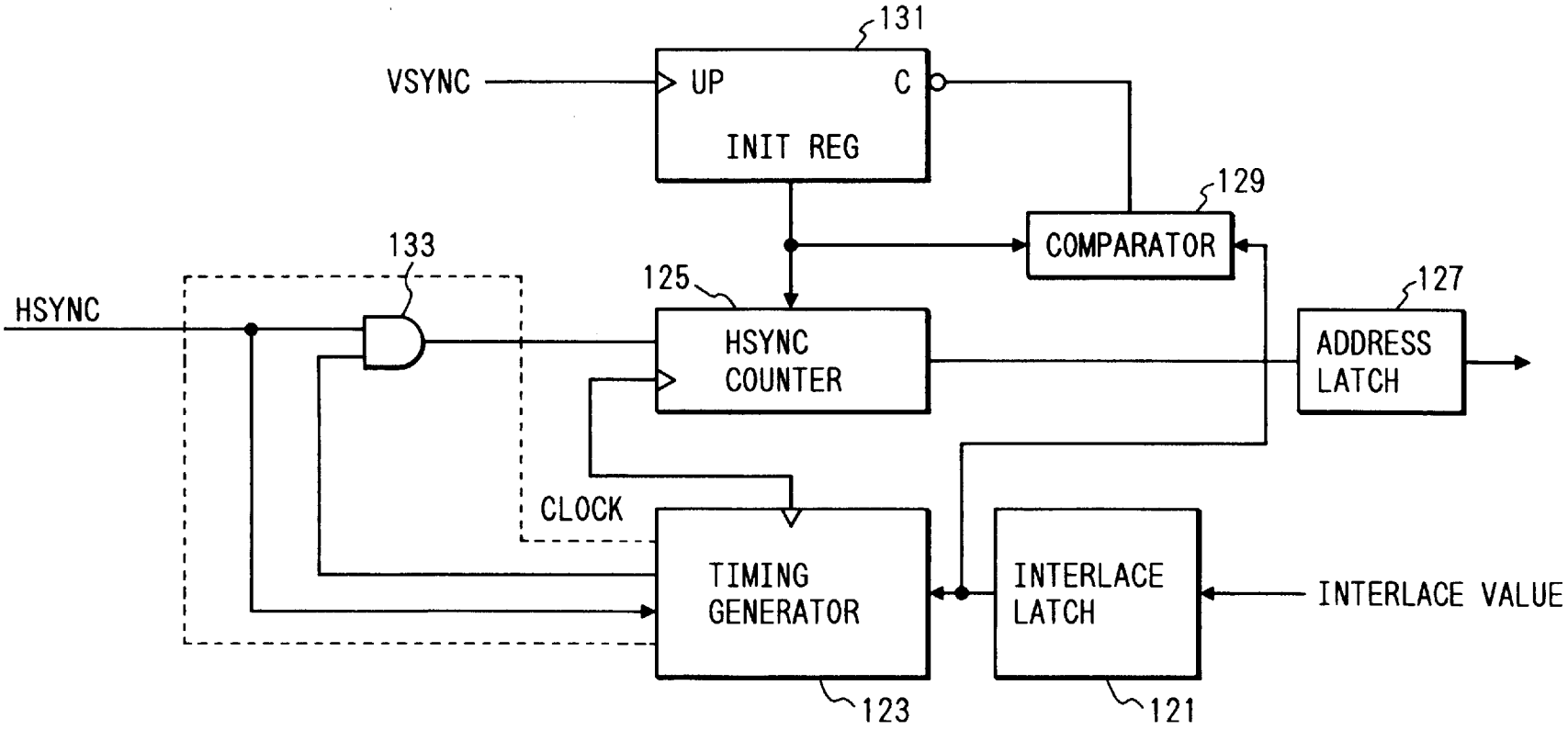
FIG. 26 is a block diagram showing the interlace line address generator according to the sixth embodiment of the present invention.

FIG. 26 is a block diagram showing the interlace line address generator arranged in the rewrite detector/flag generator 117.

Referring to FIG. 26, the interlace value obtained by the CPU 9 with reference to the table 9A is held in an interlace latch 121. A timing generator 123 generates a count-up enable time of an Hsync counter 125 in accordance with the interlace value held in the interlace latch 121.

Figure 27:
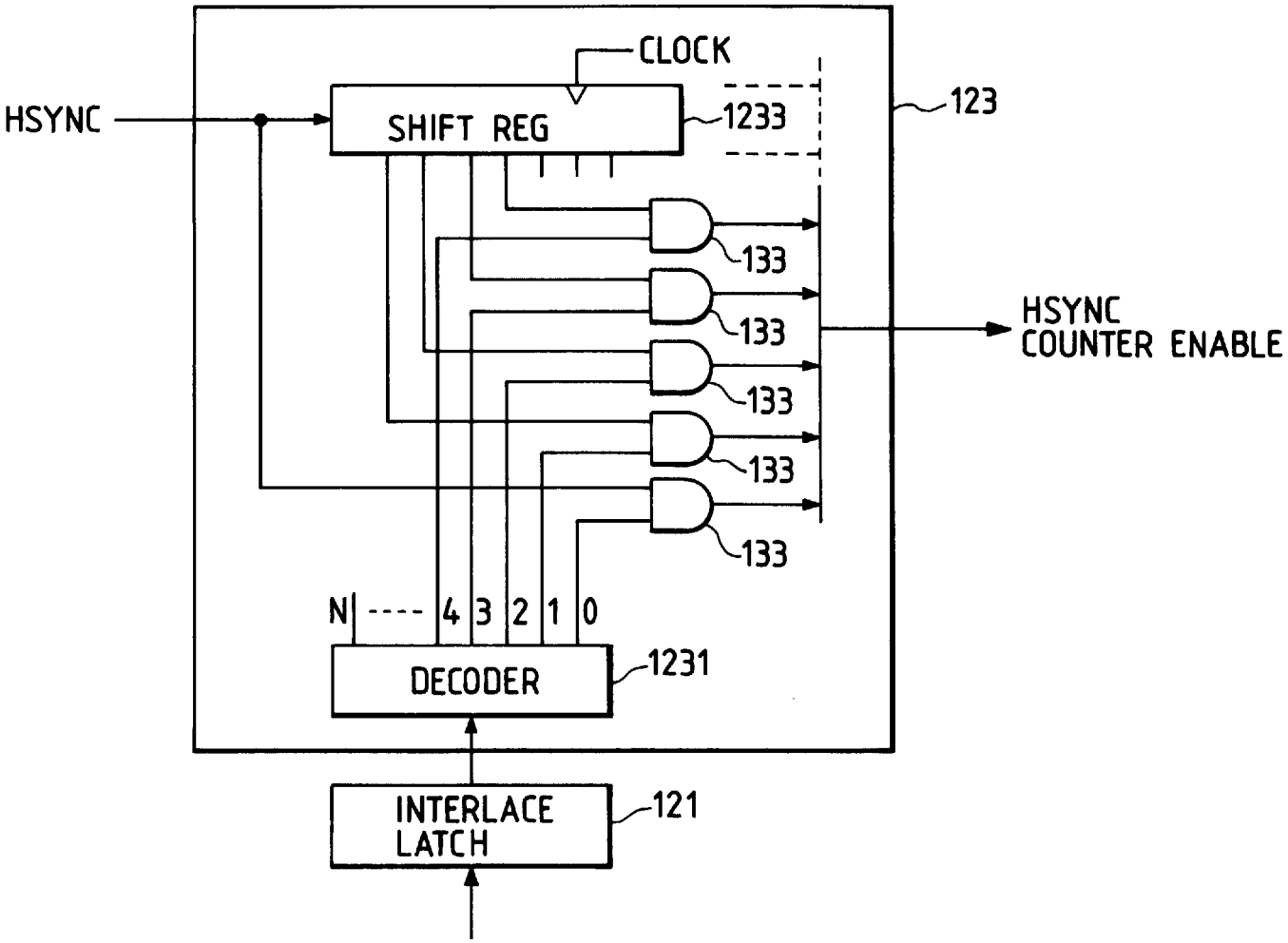
FIG. 27 is a block diagram showing the detailed arrangement of a timing generator shown in FIG. 26.
Figure 29:
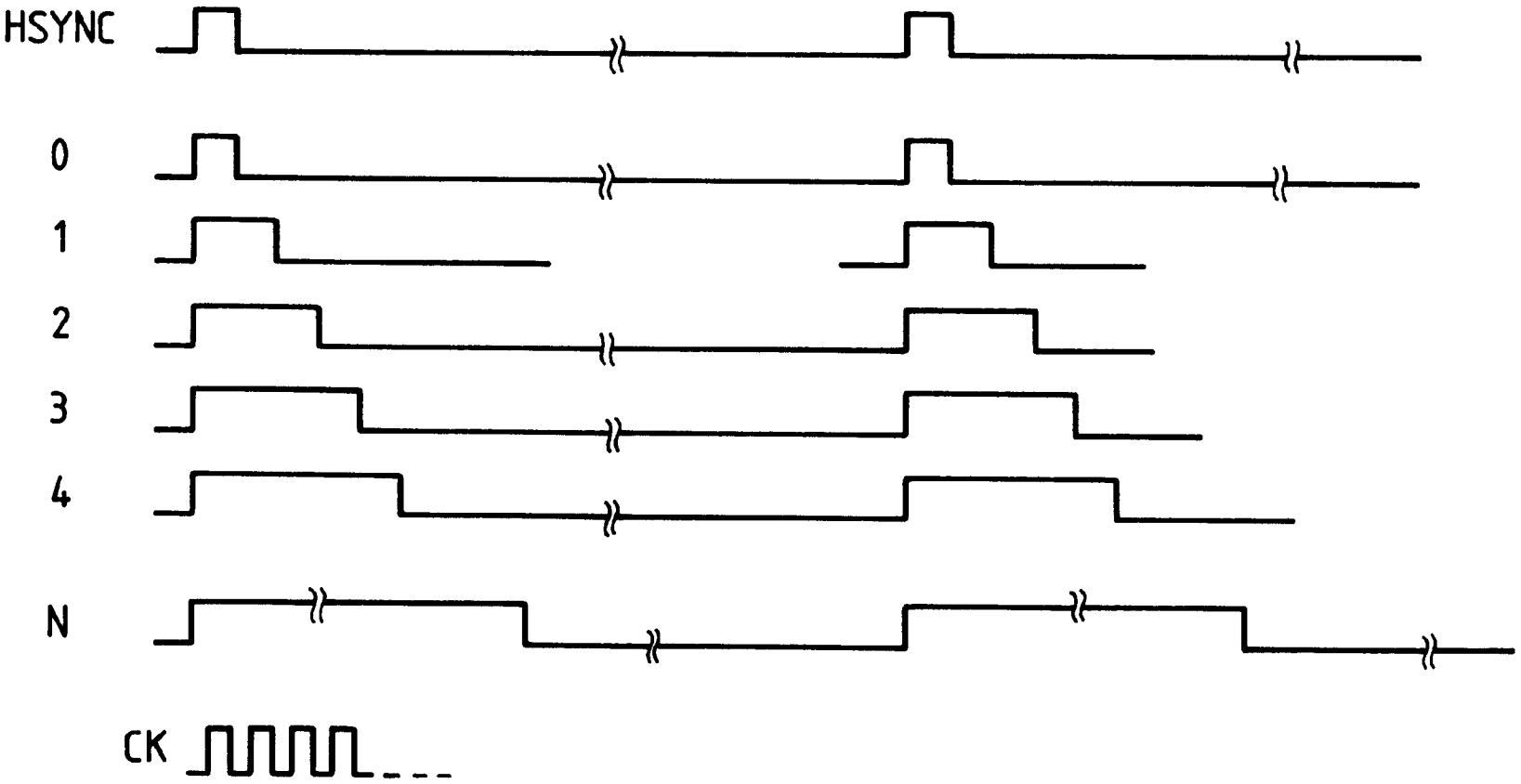
FIG. 29 is a waveform chart showing count-up enable time generated by the timing generator.

FIG. 27 is a detailed block diagram of the timing generator. Referring to FIG. 27, a decoder 1231 outputs a decoded signal having a relationship shown in FIG. 28 in accordance with the interlace value. Each output from the decoder 1231 is input to one input terminal of a corresponding one of AND gates. The other terminal of each of the AND gates 133 receives each bit signal from a shift register 1233 for performing a shift operation in synchronism with a clock. As a result, the timing generator 123 outputs a count-up enable signal (time) having a length corresponding to each interlace value shown in FIG. 29.

The Hsync counter 125 performs a count-up operation in synchronism with the clock during the count-up enable time. The resultant count value is held in an address latch 127 at a predetermined timing.

An initial register 131 holds an initial value (start address) of the Hsync counter 125. A comparator 129 compares the value of the interlace latch 121 with the value of the initial register 131. If these input values are equal to each other, the comparator 129 clears the value of the initial register 131.

Figure 30:
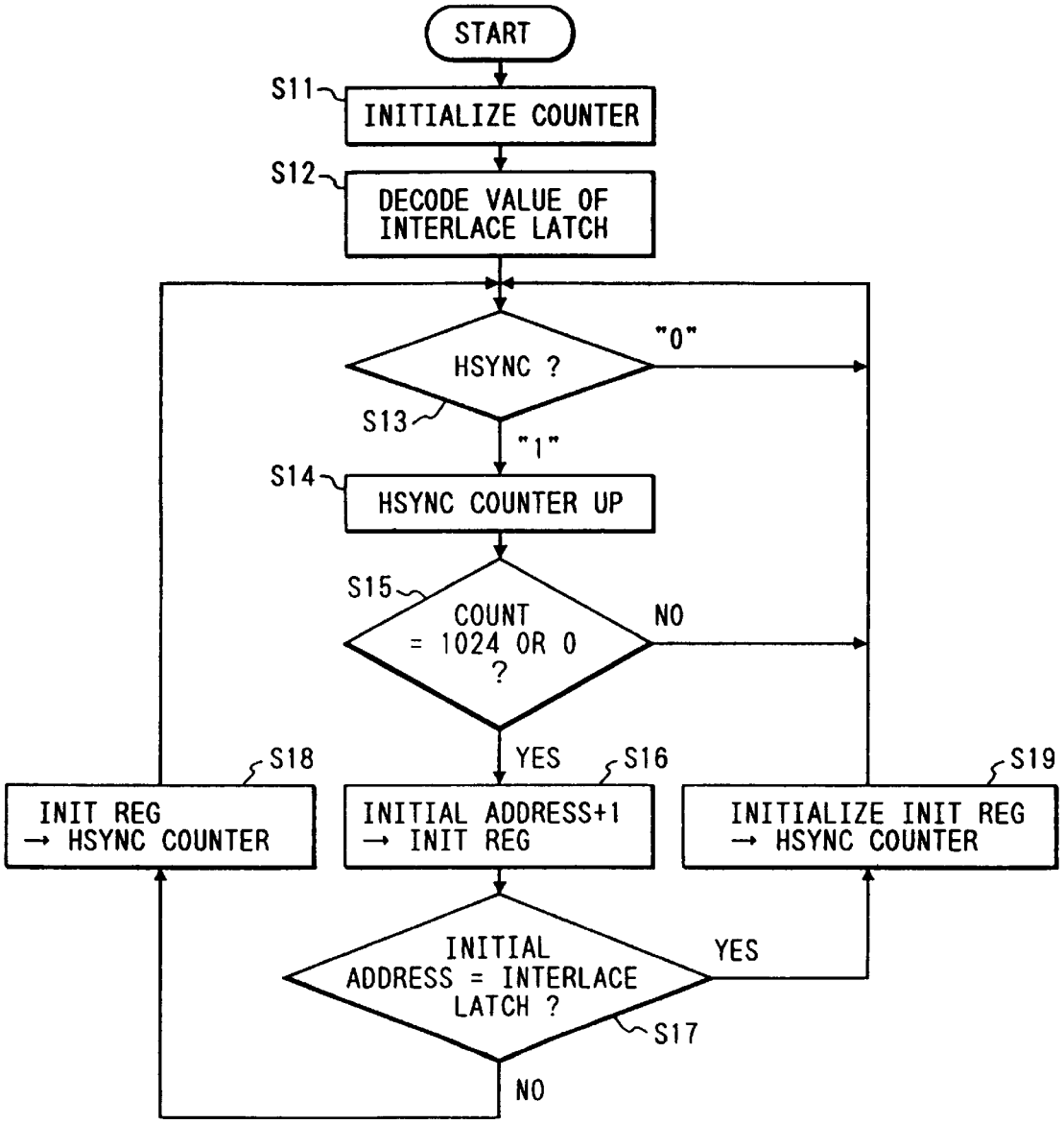
FIG. 30 is a flow chart showing the sequence flow of an interlace line address generator shown in FIG. 26.

FIG. 30 is a flow chart showing a process flow of the interlace line address generator shown in FIG. 26.

The initialization of the counter 125 is performed in step S11. In step S12, the value of the interlace latch is decoded by the decoder 1231. In steps S13 and S14, every time the signal Hsync goes to "1", the count-up operation is performed during the count enable time determined by the decoded interlace value. The address latch 128 latches the count value at the fall of this enable time. The latched count value is transferred as display line address data for interlace display to the line address generator 7. That is, the display lines are interlaced in accordance with the count value.

In step S15, steps S13 and S14 are repeated until the number of display lines of the FLCD 20 becomes 1,024 or 0. If the number of display lines becomes equal to 1,024 or 0, the initial address of the initial register 131 is incremented by one in step S16. It is determined in step S17 that the initial address becomes equal to the interlace value, the initial address of the initial register 131 is initialized in step S19. The initialized value is set as the initial value of the Hsync counter 125. If the initial address does not reach the interlace value, this value is defined as the initial value of the counter 125 in step S18.

Figure 31:
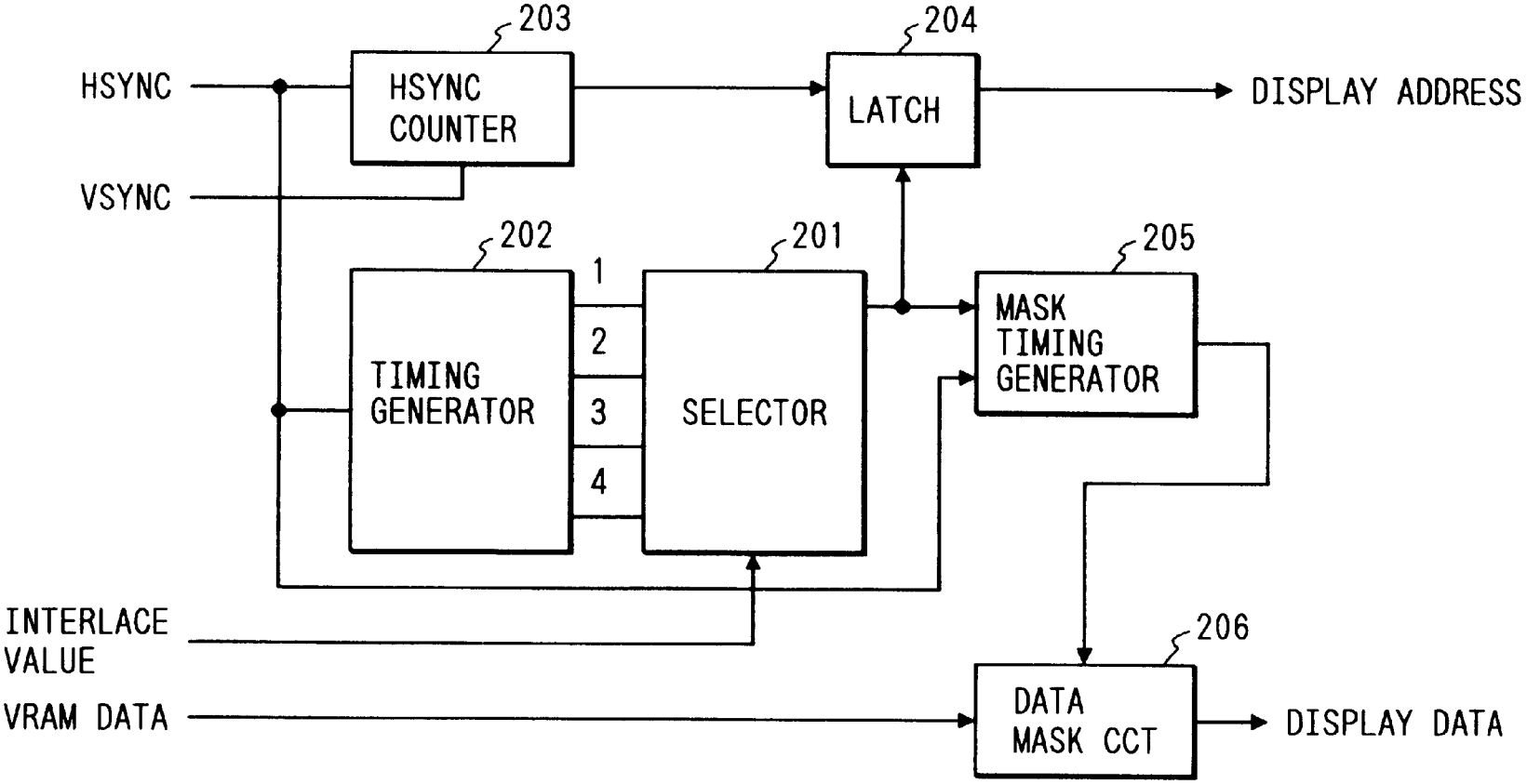
FIG. 31 is a block diagram showing another arrangement of the interlace line address generator.
Figure 32:
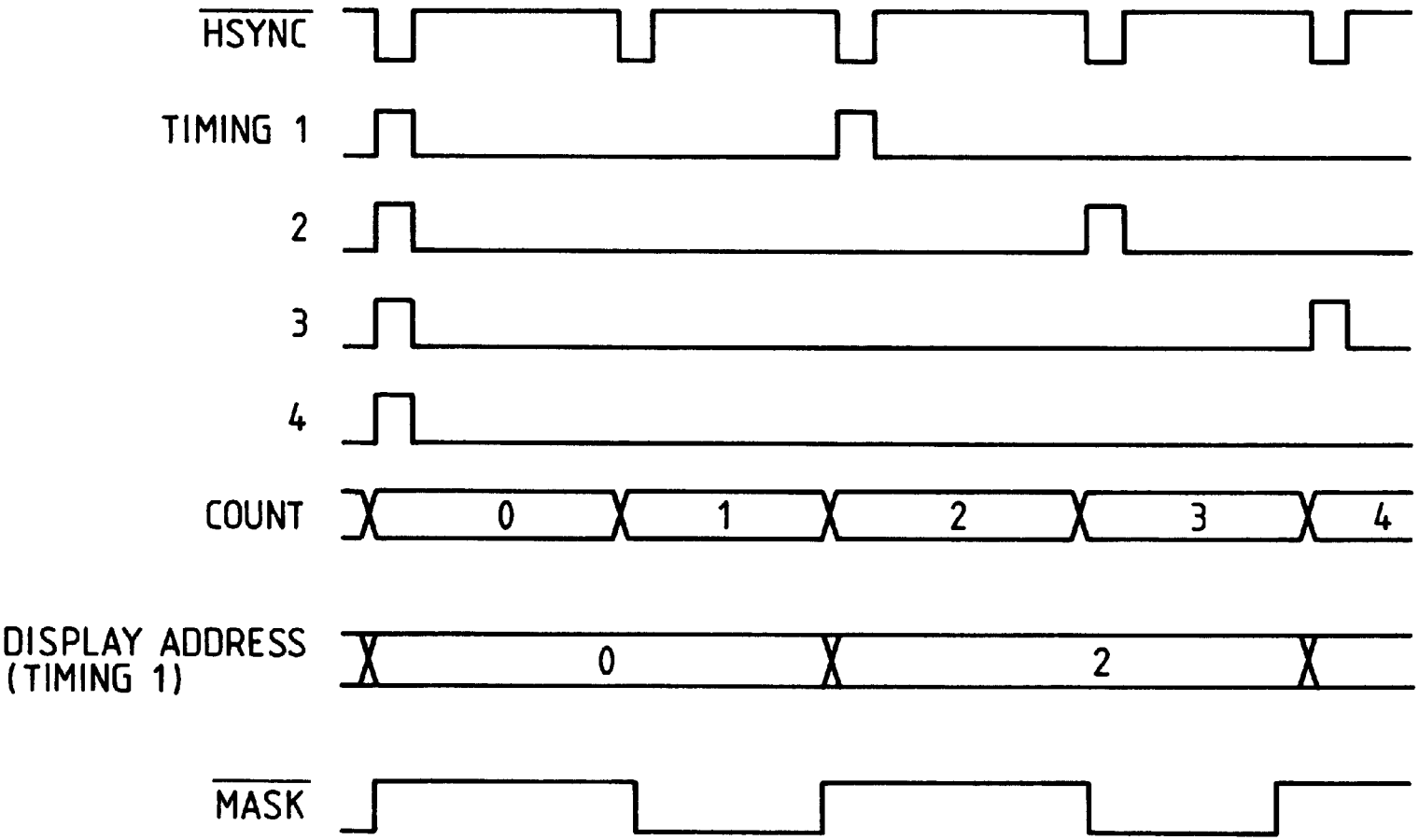
FIG. 32 is a timing chart showing operations in the generator shown in FIG. 31.

FIG. 31 is a block diagram showing another arrangement of the interlace line address generator, and FIG. 32 is a timing chart thereof.

An Hsync counter 203 counts up a signal $\overline{\text{Hsync}}$, and a latch 204 latches this count value in response to any one of timing signals 1 to 4 transferred from a timing generator 202 through a selector 201. For example, assume the timing signal 1. As shown in FIG. 32, when the first timing signal 1 is set at "1", the counter value is zero. The display line address becomes zero. When the next timing signal 1 is set at "1", the counter value is 2, and the display line address becomes 2. In this case, one-interlace display is performed.

The signals 1 to 4 from the timing generator 202 are also input to a mask timing generator 205 through the selector 201. An output mask timing signal is input to a data mask circuit 206, thereby masking the display data from the VRAM when the $\overline{\text{mask}}$ is set at "0".

As is apparent from the above description, according to the present invention, an address corresponding to an interlace value set by the interlace generator arranged in the display controller is generated. Interlace display is performed on the basis of the display data of this address.

What is claimed is:

1. A display control apparatus for a display device capable of performing updating of a display state for a display element subjected to a change in display, comprising:

display data memory means for storing display data;

a display controller capable of sequentially reading out the display data stored in said memory means and transferring the readout display data to said display device at a predetermined period and capable of performing a partial rewrite operation on the display device on the basis of the display data stored in said memory means;

rewrite detecting means for detecting an address for accessing said display data memory means to cause said display controller to perform the partial rewrite operation;

address generating means for generating an address of said display data memory means used for reading the display data by said display controller; and transfer means for transferring the display data of a number of lines immediately following transfer of the address of a first line of the number of lines generated by said address generating means designating the number of lines from said display data memory means to said display controller.

2. An apparatus according to claim 1, wherein said address generating means generates the address and the number of lines, and said transfer means transfers the display data of the number of lines generated.

3. A display control apparatus according to claim 1, wherein said rewrite detecting means includes a flag register for an address of display data in said display data memory means and effects setting a flag register of a detected address.

4. A display control apparatus according to claim 1, wherein said transfer means transfers display data at a period according to a display driving period of said display device.

5. A display control apparatus according to claim 4, wherein the display driving period depends on a temperature of said display device.

6. A display control apparatus for a display device capable of performing updating of a display state for a display element subjected to a change in display, comprising:

display data memory means for storing display data;

a display controller capable of sequentially reading out the display data stored in said memory means and transferring the readout display data to said display device at a predetermined period and capable of performing a partial rewrite operation on the display device on the basis of the display data stored in said memory means:

rewrite detecting means for detecting an address for accessing said display data memory means to cause said display controller to perform the partial rewrite operation;

address generating means for generating an address of said display data memory means used for reading the display data by said display controller; and transfer means for transferring the display data of a number of lines together from said display data memory means to said display controller on the basis of the address generated by said address generating means, wherein said address generating means generates the address and the number of lines, and said transfer means transfers the display data of the number of lines generated, and said address generating means sequentially generates a first address, the number of lines, and a second address, and wherein said transfer means transfers the display data of the number of lines on the basis of the generated first address but does not transfer the display data up to the generated second address.

7. A display control apparatus according to claim 6, wherein said rewrite detecting means includes a flag register for an address of display data in said display data memory means and effects setting a flag register of a detected address.

8. A display control apparatus according to claim 6, wherein said transfer means transfers display data at a period according to a display driving period of said display device.

9. A display control apparatus according to claim 8, wherein the display driving period depends on a temperature of said display device.

10. A method of controlling a display device capable of updating a display state for a display element subjected to a change in display, comprising the steps of:

storing display data in a display data memory;

providing a display controller capable of sequentially reading out the display data stored in the display data memory and transferring the readout display data to the display device at a predetermined period and capable of performing a partial rewrite operation on the display device on the basis of the display data stored in the display data memory;

providing a rewrite detector for detecting an address for accessing the display data memory to cause the display controller to perform the partial rewrite operation;

providing an address generator for generating an address of the display data memory used for reading the display data by the display controller; and transferring the display data of a number of lines immediately following transfer of the address of a first line of the number of lines generated by the address generator designating the number of lines from the display data memory means to the display controller.

11. A method according to claim 10, further comprising the steps of:

generating the address and the number of lines; and transferring the display data of the number of lines generated.

12. A method according to claim 10, wherein the rewrite detector includes a flag register for an address of display data in the display data memory, and further comprising the step of setting a flag register of a detected address.

13. A method according to claim 10, further comprising the step of transferring display data at a period according to a display driving period of the display device.

14. A method according to claim 13, wherein the display driving period depends on a temperature of the display device.

15. A method of controlling a display device capable of updating a display state for a display element subjected to a change in display, comprising:

storing display data in a display data memory;

providing a display controller capable of sequentially reading out the display data stored in the display data memory and transferring the readout display data to the display device at a predetermined period and capable of performing a partial rewrite operation on the display device on the basis of the display data stored in the display data memory;

providing a rewrite detector for detecting an address for accessing the display data memory to cause the display controller to perform the partial rewrite operation;

providing an address generator for generating an address of the display data memory used for reading the display data by the display controller; and transferring the display data of a number of lines together with the address generated by said address generator designating the number of lines from the display data memory to the display controller, wherein the address generator generates the address and the number of lines and the display data of the number of lines generated is transferred, and the address generator sequentially generates a first address, the number of lines, and a second address, and the display data of the number of lines is transferred on the basis of the generated first address but does not transfer the display data up to the generated second address.

* * * * *

UNITED STATES PATENT AND TRADEMARK OFFICE

CERTIFICATE OF CORRECTION

PATENT NO. : 6,157,359
DATED : December 5, 2000
INVENTOR(S) : Masami Shimakura et al.

It is certified that error appears in the above-identified patent and that said Letters Patent is hereby corrected as shown below:

Column 5,
Line 25, "to" should read -- to as --.

Column 13,
Line 5, "get" should read -- set --.

Column 17,
Line 4, "An apparatus" should read -- A display control apparatus --.

Signed and Sealed this

Twenty-fifth Day of December, 2001

*Attest:*

*Attesting Officer*

JAMES E. ROGAN
*Director of the United States Patent and Trademark Office*